US010862216B1

(12) United States Patent
Ayala Vazquez et al.

(10) Patent No.: US 10,862,216 B1
(45) Date of Patent: Dec. 8, 2020

(54) ELECTRONIC DEVICES HAVING INDIRECTLY-FED SLOT ANTENNA ELEMENTS

(71) Applicant: Apple Inc., Cupertino, CA (US)

(72) Inventors: Enrique Ayala Vazquez, Watsonville, CA (US); Erdinc Irci, Sunnyvale, CA (US); Georgios Atmatzakis, Cupertino, CA (US); Hongfei Hu, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 49 days.

(21) Appl. No.: 16/457,515

(22) Filed: Jun. 28, 2019

(51) Int. Cl.
*H01Q 13/10* (2006.01)
*H01Q 9/14* (2006.01)
*H01Q 1/24* (2006.01)

(52) U.S. Cl.
CPC ..... *H01Q 13/103* (2013.01); *H01Q 1/243* (2013.01); *H01Q 9/145* (2013.01)

(58) Field of Classification Search
CPC ..... H01Q 13/10; H01Q 13/103; H01Q 1/243; H01Q 9/145
See application file for complete search history.

(56) References Cited

U.S. PATENT DOCUMENTS 8,638,062 B2 1/2014 Baarman et al.
8,963,784 B2 2/2015 Zhu et al.
9,236,648 B2 1/2016 Guterman et al.
9,685,791 B2 6/2017 Yoon et al.
9,843,226 B2 12/2017 Lee et al.
9,876,272 B2 1/2018 Hu et al.
9,972,891 B2 5/2018 Vazquez et al.
2013/0169497 A1* 7/2013 Wong ..... H01Q 9/40 343/770
2019/0181554 A1* 6/2019 Lee ..... H01Q 9/30
2019/0181891 A1* 6/2019 Harper ..... H01Q 13/10
2019/0260126 A1 8/2019 Vazquez et al.

OTHER PUBLICATIONS

U.S. Appl. No. 16/019,322, filed Jun. 26, 2018.

* cited by examiner

*Primary Examiner* — Hoang V Nguyen
(74) *Attorney, Agent, or Firm* — Treyz Law Group, P.C.; Michael H. Lyons

(57) ABSTRACT

An electronic device may include ground structures and peripheral conductive housing structures defining opposing edges of a slot element. A monopole element may overlap the slot element. The monopole element may be directly fed radio-frequency signals by an antenna feed coupled to the monopole element. The monopole element may radiate the radio-frequency signals in a first frequency band while indirectly feeding the radio-frequency signals to the slot element via near-field electromagnetic coupling. The slot element may radiate the radio-frequency signals in a second frequency band that is lower than the first frequency band. The monopole element and the slot element may collectively form a multi-band antenna that exhibits a relatively wide bandwidth.

20 Claims, 13 Drawing Sheets

ELECTRONIC DEVICES HAVING INDIRECTLY-FED SLOT ANTENNA ELEMENTS

BACKGROUND

This relates to electronic devices, and more particularly, to antennas for electronic devices with wireless communications circuitry.

Electronic devices often include wireless communications circuitry. For example, cellular telephones, computers, and other devices often contain antennas and wireless transceivers for supporting wireless communications.

To satisfy consumer demand for small form factor wireless devices, manufacturers are continually striving to implement wireless communications circuitry such as antenna components using compact structures. At the same time, there is a desire for wireless devices to cover a growing number of communications bands. For example, it may be desirable for a wireless device to cover many different cellular telephone communications bands at different frequencies.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over the desired range of operating frequencies. In addition, it is often difficult to perform wireless communications with a satisfactory data rate (data throughput), especially as software applications performed by wireless devices become increasingly data hungry.

It would therefore be desirable to be able to provide improved wireless communications circuitry for wireless electronic devices.

SUMMARY

An electronic device may be provided with wireless circuitry and a housing having peripheral conductive housing structures. The electronic device may include ground structures. The ground structures and the peripheral conductive housing structures may define opposing edges of a slot element. Conductive interconnect structures may couple the peripheral conductive housing structures to the ground structures and may define additional edges of the slot element.

The electronic device may include a monopole element overlapping the slot element. The monopole element may be directly fed radio-frequency signals by an antenna feed coupled to the monopole element. The monopole element may radiate the radio-frequency signals in a first frequency band while indirectly feeding the radio-frequency signals to the slot element via near-field electromagnetic coupling. The slot element may radiate the radio-frequency signals in a second frequency band that is lower than the first frequency band. The monopole element and the slot element may collectively form a multi-band antenna that exhibits a relatively wide bandwidth (e.g., for covering a frequency band from 3300 MHz to 5000 MHz).

A dielectric support structure may overlap the slot element. The dielectric support structure may provide mechanical support for a display at a front face of the device. The multi-band antenna may be fed by a radio-frequency transmission line having a signal conductor on a flexible printed circuit. A conductive screw may extend through the flexible printed circuit and at least some of the dielectric support structure to electrically couple the signal conductor to the monopole element. Antenna tuning components may be mounted to the flexible printed circuit and may be coupled to the monopole element and/or the peripheral conductive housing structures using conductive screws.

DETAILED DESCRIPTION

Figure 1:
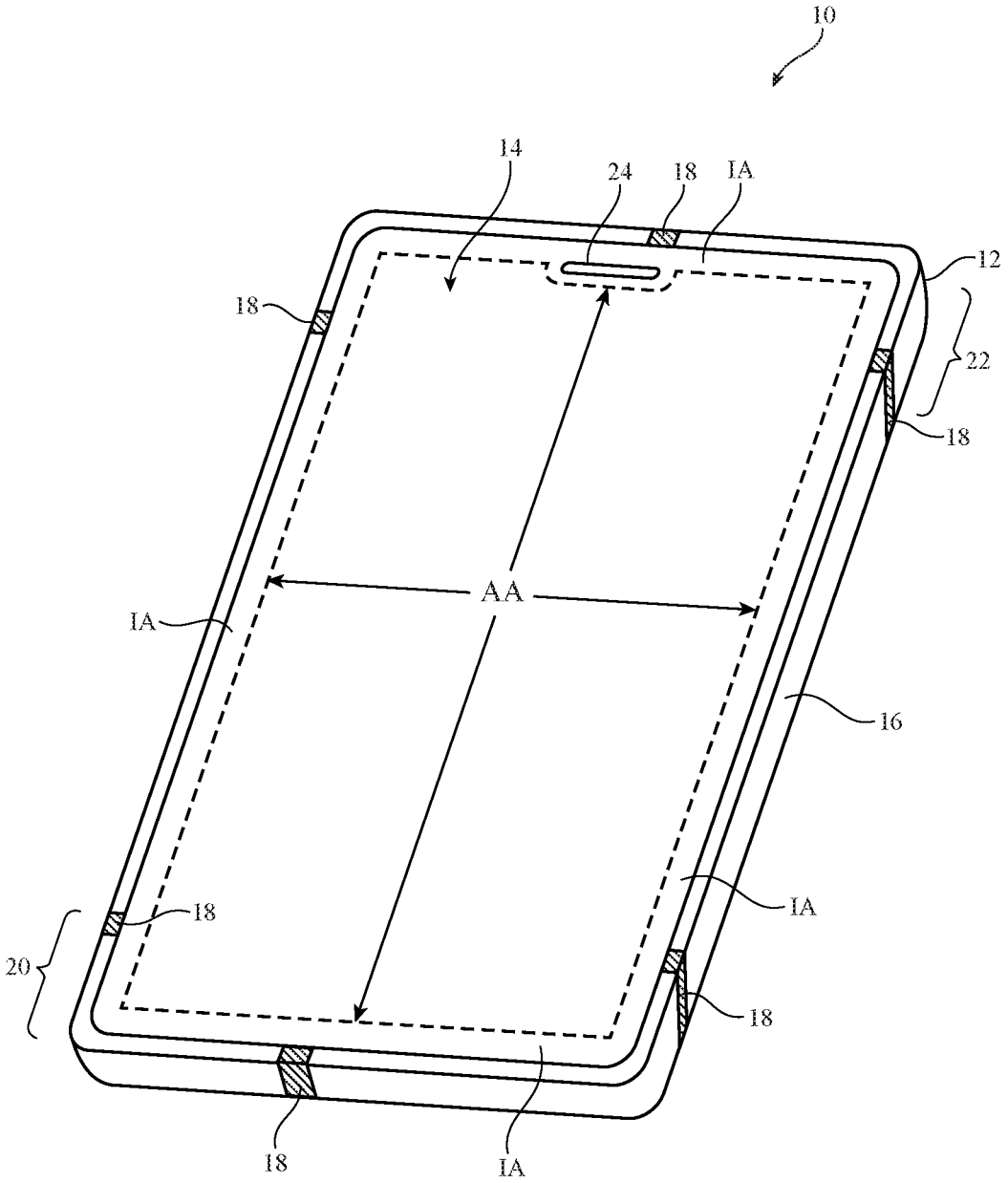
FIG. 1 is a perspective view of an illustrative electronic device with wireless communications circuitry in accordance with some embodiments.

Electronic devices such as electronic device 10 of FIG. 1 may be provided with wireless communications circuitry. The wireless communications circuitry may be used to support wireless communications in multiple wireless communications bands.

The wireless communications circuitry may include one or more antennas. The antennas of the wireless communications circuitry can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The housing structures may include peripheral structures such as peripheral conductive structures that run around the periphery of the electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a rear housing wall (e.g., a planar housing wall). The rear housing wall may have slots that pass entirely through the rear housing wall and that therefore separate housing wall portions (rear housing wall portions and/or sidewall portions) of housing 12 from each other. The rear housing wall may include conductive portions and/or dielectric portions. If desired, the rear housing wall may include a planar metal layer covered by a thin layer or coating of dielectric such as glass, plastic, sapphire, or ceramic. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. If desired, buttons may pass through openings in the cover layer. The cover layer may also have other openings such as an opening for speaker port 24.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, peripheral conductive housing sidewall structures, peripheral conductive housing sidewalls, peripheral conductive sidewalls, or a peripheral conductive housing member (as examples). Peripheral conductive housing structures 16 may be formed from a metal such as stainless steel, aluminum, or other suitable materials. One, two, three, four, five, six, or more than six separate structures may be used in forming peripheral conductive housing structures 16.

It is not necessary for peripheral conductive housing structures 16 to have a uniform cross-section. For example, the top portion of peripheral conductive housing structures 16 may, if desired, have an inwardly protruding lip that helps hold display 14 in place. The bottom portion of peripheral conductive housing structures 16 may also have an enlarged lip (e.g., in the plane of the rear surface of device 10). Peripheral conductive housing structures 16 may have substantially straight vertical sidewalls, may have sidewalls that are curved, or may have other suitable shapes. In some configurations (e.g., when peripheral conductive housing structures 16 serve as a bezel for display 14), peripheral conductive housing structures 16 may run around the lip of housing 12 (i.e., peripheral conductive housing structures 16 may cover only the edge of housing 12 that surrounds display 14 and not the rest of the sidewalls of housing 12).

If desired, housing 12 may have a conductive rear surface or wall. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a conductive rear housing wall of device 10 may be formed from a planar metal structure and portions of peripheral conductive housing structures 16 on the sides of housing 12 may be formed as flat or curved vertically extending integral metal portions of the planar metal structure. Housing structures such as these may, if desired, be machined from a block of metal and/or may include multiple metal pieces that are assembled together to form housing 12. The conductive rear wall of housing 12 may have one or more, two or more, or three or more portions. Peripheral conductive housing structures 16 and/or the conductive rear wall of housing 12 may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide structures 16 and/or the conductive rear wall of housing 12 from view of the user).

Display 14 may have an array of pixels that form an active area AA that displays images for a user of device 10. An inactive border region such as inactive area IA may run along one or more of the peripheral edges of active area AA.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of member 16). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 16 and opposing conductive ground structures such as conductive portions of the rear wall of housing 12, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22.

In general, device 10 may include any suitable number of antennas (e.g., one or more, two or more, three or more, four or more, etc.). The antennas in device 10 may be located at opposing first and second ends of an elongated device housing (e.g., in regions 20 and 22 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 16 may be provided with peripheral gap structures. For example, peripheral conductive housing structures 16 may be provided with one or more gaps such as gaps 18, as shown in FIG. 1. The gaps in peripheral conductive housing structures 16 may be filled with dielectric such as polymer, ceramic, glass, air, other dielectric materials, or combinations of these materials. Gaps 18 may divide peripheral conductive housing structures 16 into one or more peripheral conductive segments. There may be, for example, two peripheral conductive segments in peripheral conductive housing structures 16 (e.g., in an arrangement with two of gaps 18), three peripheral conductive segments (e.g., in an arrangement with three of gaps 18), four peripheral conductive segments (e.g., in an arrangement with four of gaps 18), six peripheral conductive segments (e.g., in an arrangement with six gaps 18), etc. The segments of peripheral conductive housing structures 16 that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 16 and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have one or more upper antennas and one or more lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, etc.

Figure 2:
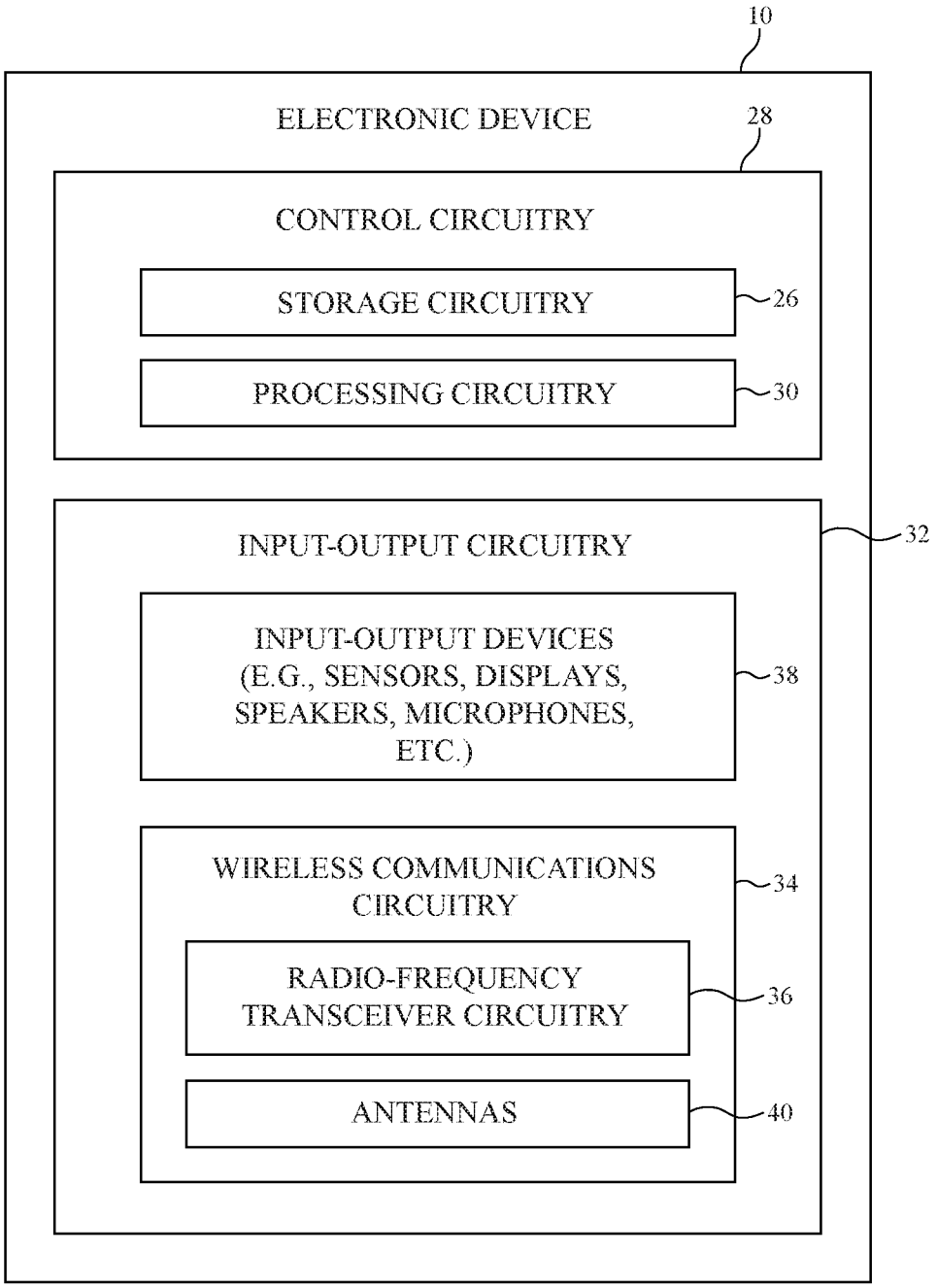
FIG. 2 is a schematic diagram of illustrative circuitry in an electronic device in accordance with some embodiments.

A schematic diagram showing illustrative components that may be used in device 10 of FIG. 1 is shown in FIG. 2. As shown in FIG. 2, device 10 may include control circuitry 28. Control circuitry 28 may include storage such as storage circuitry 26. Storage circuitry 26 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 28 may include processing circuitry such as processing circuitry 30. Processing circuitry 30 may be used to control the operation of device 10. Processing circuitry 30 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 26 (e.g., storage circuitry 26 may include non-transitory (tangible) computer readable storage media that stores the software code). The software code may sometimes be referred to as program instructions, software, data, instructions, or code. Software code stored on storage circuitry 26 may be executed by processing circuitry 30.

Control circuitry 28 may be used to run software on device 10 such as satellite navigation applications, internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as Wi-Fi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols (e.g., global positioning system (GPS) protocols, global navigation satellite system (GLONASS) protocols, etc.), or any other desired communications protocols. Each communications protocol may be associated with a corresponding radio access technology (RAT) that specifies the physical connection methodology used in implementing the protocol.

Device 10 may include input-output circuitry 32. Input-output circuitry 32 may include input-output devices 38. Input-output devices 38 may be used to allow data to be supplied to device 10 and to allow data to be provided from device 10 to external devices. Input-output devices 38 may include user interface devices, data port devices, and other input-output components. For example, input-output devices 38 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors, etc.

Input-output circuitry 32 may include wireless communications circuitry such as wireless communications circuitry 34 (sometimes referred to herein as wireless circuitry 34) for wirelessly conveying radio-frequency signals. While control circuitry 28 is shown separately from wireless communications circuitry 34 in the example of FIG. 2 for the sake of clarity, wireless communications circuitry 34 may include processing circuitry that forms a part of processing circuitry 30 and/or storage circuitry that forms a part of storage circuitry 26 of control circuitry 28 (e.g., portions of control circuitry 28 may be implemented on wireless communications circuitry 34). As an example, control circuitry 28 (e.g., processing circuitry 30) may include baseband processor circuitry or other control components that form a part of wireless communications circuitry 34.

Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 36 for handling transmission and/or reception of radio-frequency signals in various radio-frequency communications bands. For example, radio-frequency transceiver circuitry 36 may handle 2.4 GHz and 5 GHz bands for Wi-Fi® (IEEE 802.11) communications or communications in other wireless local area network (WLAN) bands. Radio-frequency transceiver circuitry 36 may handle the 2.4 GHz Bluetooth® communications band or other wireless personal area network (WPAN) bands. Radio-frequency transceiver circuitry 36 may include cellular telephone transceiver circuitry for handling wireless communications in frequency ranges such as a cellular low band (LB) from 600 to 960 MHz, a cellular low-midband (LMB) from 1410 to 1510 MHz, a cellular midband (MB) from 1710 to 2170 MHz, a cellular high band (HB) from 2300 to 2700 MHz, a cellular ultra-high band (UHB) from 3300 to 5000 MHz, or other communications bands between 600 MHz and 5000 MHz or other suitable frequencies (as examples).

In one suitable arrangement, radio-frequency transceiver circuitry 36 may handle 4G frequency bands between 3300 and 5000 MHz such as Long Term Evolution (LTE) bands B42 (e.g., 3400 MHz-3600 MHz) and B48 (e.g., 3500-3700) as well as 5G frequency bands (e.g., 5G NR bands) below 6 GHz such as 5G bands N77 (e.g., 3300-4200 MHz), N78 (e.g., 3300-3800 MHz), and N79 (e.g., 4400-5000 MHz). If desired, radio-frequency transceiver circuitry 36 may include a first transceiver integrated circuit (chip) for handling 4G communications and a second transceiver integrated circuit (chip) for handling 5G communications (e.g., the first transceiver integrated circuit may operate under a 4G radio access technology whereas the second transceiver integrated circuit may operate under a 5G radio access technology). Each transceiver integrated circuit may be coupled to one or of the same antennas over one or more radio-frequency transmission lines. For example, each transceiver integrated circuit may be coupled to the same antenna feeds or different antenna feeds of the same antenna via the same radio-frequency transmission line or via separate radio-frequency transmission lines. Filter circuitry (e.g., duplexer circuitry, diplexer circuitry, low pass filter circuitry, high pass filter circuitry, band pass filter circuitry, band stop filter circuitry, etc.), switching circuitry, multiplexing circuitry, or any other desired circuitry may be used to isolate radio-frequency signals conveyed by the first and second transceiver integrated circuits over the same antennas or antenna feeds (e.g., filtering circuitry or multiplexing circuitry may be interposed on a radio-frequency transmission line shared by the first and second transceiver integrated circuits).

Radio-frequency transceiver circuitry 36 may handle voice data and non-voice data. Radio-frequency transceiver circuitry 36 may include circuitry for other short-range and long-range wireless links if desired. For example, radio-frequency transceiver circuitry 36 may include 60 GHz transceiver circuitry (e.g., millimeter wave transceiver circuitry), circuitry for receiving television and radio signals, paging system transceivers, near field communications (NFC) circuitry, etc. Radio-frequency transceiver circuitry 36 may include global positioning system (GPS) receiver circuitry for receiving GPS signals at 1575 MHz or for handling other satellite positioning data. In Wi-Fi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
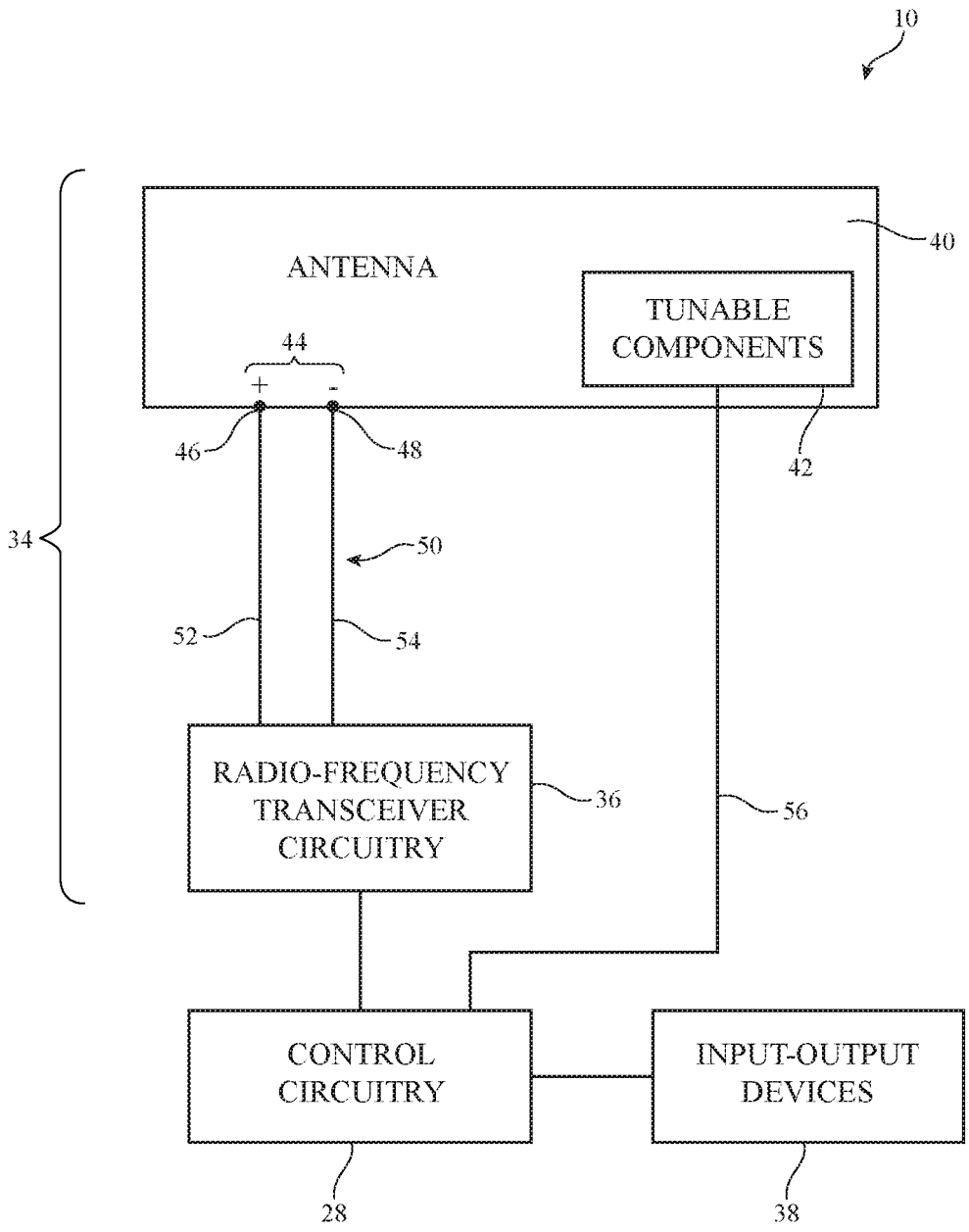
FIG. 3 is a schematic diagram of illustrative wireless communications circuitry in accordance with some embodiments.

As shown in FIG. 3, radio-frequency transceiver circuitry 36 in wireless communications circuitry 34 may be coupled to antenna structures such as a given antenna 40 using paths such as path 50. Wireless communications circuitry 34 may be coupled to control circuitry 28. Control circuitry 28 may be coupled to input-output devices 38. Input-output devices 38 may supply output from device 10 and may receive input from sources that are external to device 10.

To provide antenna structures such as antenna 40 with the ability to cover communications frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components 42 to tune the antenna over communications (frequency) bands of interest. Tunable components 42 may be part of a tunable filter or tunable impedance matching network, may be part of an antenna resonating element, may span a gap between an antenna resonating element and antenna ground, etc.

Tunable components 42 may include tunable inductors, tunable capacitors, or other tunable components. Tunable components such as these may be based on switches and networks of fixed components, distributed metal structures that produce associated distributed capacitances and inductances, variable solid-state devices for producing variable capacitance and inductance values, tunable filters, or other suitable tunable structures. During operation of device 10, control circuitry 28 may issue control signals on one or more paths such as path 56 that adjust inductance values, capacitance values, or other parameters associated with tunable components 42, thereby tuning antenna 40 to cover desired communications bands. Antenna tuning components that are used to adjust the frequency response of antenna 40 such as tunable components 42 may sometimes be referred to herein as antenna tuning components, tuning components, antenna tuning elements, tuning elements, adjustable tuning components, adjustable tuning elements, or adjustable components.

Path 50 may include one or more transmission lines. As an example, path 50 of FIG. 3 may be a transmission line having a positive signal conductor such as signal conductor 52 and a ground signal conductor such as ground conductor 54. Path 50 may sometimes be referred to herein as transmission line 50 or radio-frequency transmission line 50.

Transmission line 50 may, for example, include a coaxial cable transmission line (e.g., ground conductor 54 may be implemented as a grounded conductive braid surrounding signal conductor 52 along its length), a stripline transmission line, a microstrip transmission line, coaxial probes realized by a metalized via, an edge-coupled microstrip transmission line, an edge-coupled stripline transmission line, a waveguide structure (e.g., a coplanar waveguide or grounded coplanar waveguide), combinations of these types of transmission lines and/or other transmission line structures, etc.

Transmission lines in device 10 such as transmission line 50 may be integrated into rigid and/or flexible printed circuit boards. In one suitable arrangement, transmission lines such as transmission line 50 may also include transmission line conductors (e.g., signal conductors 52 and ground conductors 54) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network (e.g., an adjustable matching network formed using tunable components 42) may include components such as inductors, resistors, and capacitors used in matching the impedance of antenna 40 to the impedance of transmission line 50. Matching network components may be provided as discrete components (e.g., surface mount technology components) or may be formed from housing structures, printed circuit board structures, traces on plastic supports, etc. Components such as these may also be used in forming filter circuitry in antenna 40 and may be tunable and/or fixed components.

Transmission line 50 may be coupled to antenna feed structures associated with antenna 40. As an example, antenna 40 may form an inverted-F antenna, a slot antenna, a hybrid inverted-F slot antenna or other antenna having an antenna feed 44 with a positive antenna feed terminal such as positive antenna feed terminal 46 and a ground antenna feed terminal such as ground antenna feed terminal 48. Signal conductor 52 may be coupled to positive antenna feed terminal 46 and ground conductor 54 may be coupled to ground antenna feed terminal 48. Other types of antenna feed arrangements may be used if desired. For example, antenna 40 may be fed using multiple feeds each coupled to a respective port of radio-frequency transceiver circuitry 36 over a corresponding transmission line. If desired, signal conductor 52 may be coupled to multiple locations on antenna 40 (e.g., antenna 40 may include multiple positive antenna feed terminals coupled to signal conductor 52 of the same transmission line 50). Switches may be interposed on the signal conductor between radio-frequency transceiver circuitry 36 and the positive antenna feed terminals if desired (e.g., to selectively activate one or more positive antenna feed terminals at any given time). The illustrative feeding configuration of FIG. 3 is merely illustrative.

Control circuitry 28 may use information from a proximity sensor, wireless performance metric data such as received signal strength information, device orientation information from an orientation sensor, device motion data from an accelerometer or other motion detecting sensor, information about a usage scenario of device 10, information about whether audio is being played through speaker port 24 (FIG. 1), information from one or more antenna impedance sensors, information on desired frequency bands to use for communications, and/or other information in determining when antenna 40 is being affected by the presence of nearby external objects or is otherwise in need of tuning. In response, control circuitry 28 may adjust an adjustable inductor, adjustable capacitor, switch, or other tunable components such as tunable components 42 to ensure that antenna 40 operates as desired. Adjustments to tunable components 42 may also be made to extend the frequency coverage of antenna 40 (e.g., to cover desired communications bands that extend over a range of frequencies larger than antenna 40 would cover without tuning).

Antenna 40 may include antenna resonating element structures (sometimes referred to herein as radiating element structures), antenna ground plane structures (sometimes referred to herein as ground plane structures, ground structures, or antenna ground structures), an antenna feed such as feed 44, and other components (e.g., tunable components 42). Antenna 40 may be configured to form any suitable type of antenna. With one suitable arrangement, which is sometimes described herein as an example, antenna 40 is used to implement a hybrid monopole-slot antenna that includes both monopole and slot antenna resonating elements.

Figure 4:
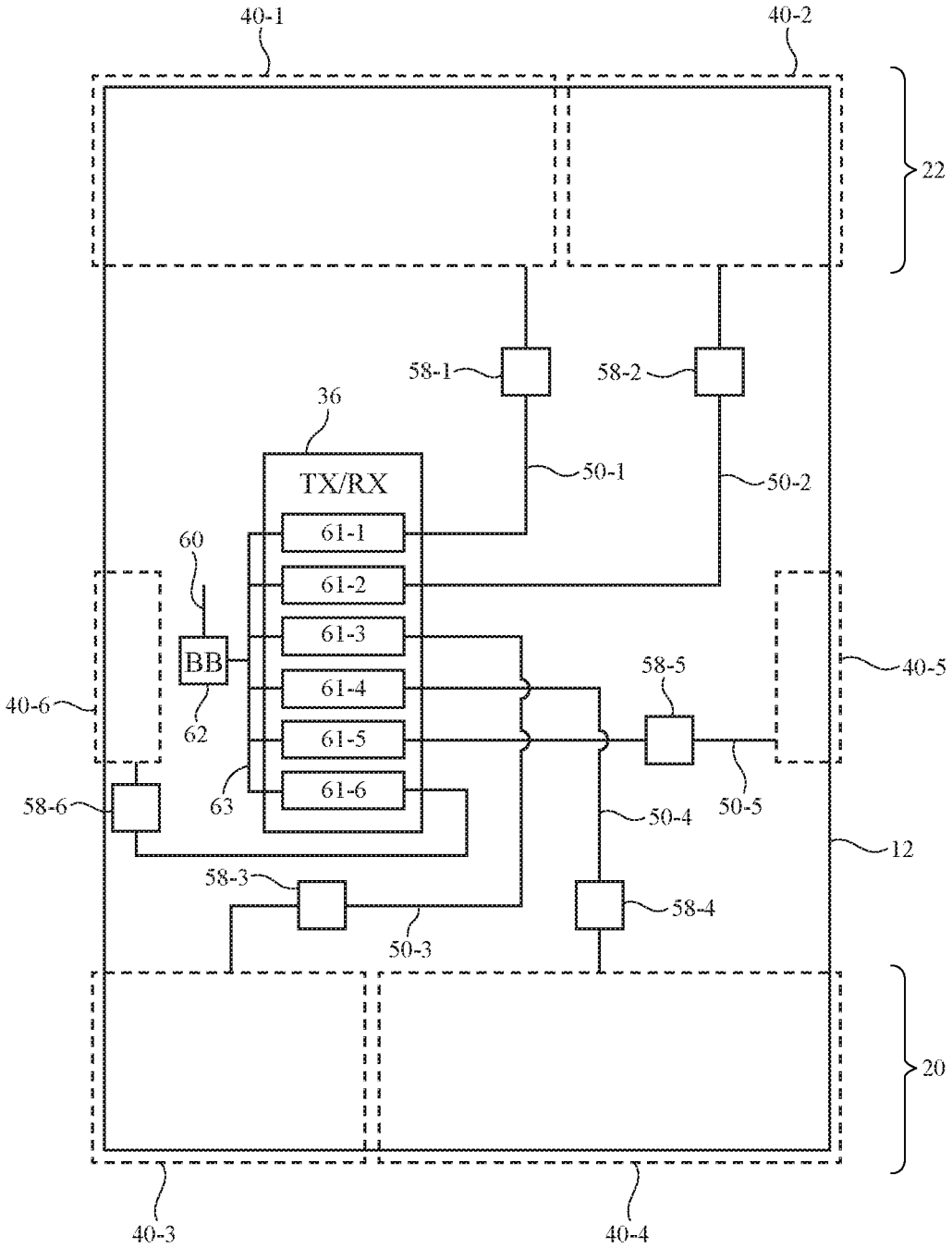
FIG. 4 is a diagram of illustrative wireless circuitry including multiple antennas for performing multiple-input and multiple-output (MIMO) communications in accordance with some embodiments.

If desired, multiple antennas 40 may be formed in device 10. Each antenna 40 may be coupled to transceiver circuitry such as radio-frequency transceiver circuitry 36 over respective transmission lines such as transmission line 50. If desired, two or more antennas 40 may share the same transmission line 50. FIG. 4 is a diagram showing how device 10 may include multiple antennas 40 for performing wireless communications.

As shown in FIG. 4, device 10 may include two or more antennas 40 such as a first antenna 40-1, a second antenna 40-2, a third antenna 40-3, a fourth antenna 40-4, a fifth antenna 40-5, and a sixth antenna 40-6. Antennas 40 may be provided at different locations within housing 12 of device 10. For example, antennas 40-1 and 40-2 may be formed within region 22 at a first (upper) end of housing 12 whereas antennas 40-3 and 40-4 are formed within region 20 at an opposing second (lower) end of housing 12, antenna 40-5 is formed at a third (right) end (edge) of housing 12, and antenna 40-6 is formed at a fourth (left) end (edge) of housing 12. In the example of FIG. 4, housing 12 has a rectangular periphery (e.g., a periphery having four corners). This example is merely illustrative and, in general, housing 12 may have any desired shape and antennas 40 may be formed at any desired locations within or on housing 12.

Wireless communications circuitry 34 may include input-output ports such as port 60 for interfacing with digital data circuits in control circuitry (e.g., control circuitry 28 of FIG. 3). Wireless communications circuitry 34 may include baseband circuitry such as baseband (BB) processor 62 and radio-frequency transceiver circuitry such as radio-frequency transceiver circuitry 36.

Port 60 may receive digital data from control circuitry that is to be transmitted by radio-frequency transceiver circuitry 36. Incoming data that has been received by radio-frequency transceiver circuitry 36 and baseband processor 62 may be supplied to control circuitry via port 60.

Radio-frequency transceiver circuitry 36 may include one or more transmitters and one or more receivers. For example, radio-frequency transceiver circuitry 36 may include multiple remote wireless transceivers 61 such as a first transceiver 61-1, a second transceiver 61-2, a third transceiver 61-3, a fourth transceiver 61-4, a fifth transceiver 61-5, and a sixth transceiver 61-6 (e.g., transceiver circuits for handling voice and non-voice' cellular telephone communications in cellular telephone communications bands). Each transceiver 61 may be coupled to a respective antenna 40 over a corresponding transmission line 50 (e.g., a first transmission line 50-1, a second transmission line 50-2, a third transmission line 50-3, a fourth transmission line 50-4, a fifth transmission line 50-5, and a sixth transmission line 50-6). For example, first transceiver 61-1 may be coupled to antenna 40-1 over transmission line 50-1, second transceiver 61-2 may be coupled to antenna 40-2 over transmission line 50-2, third transceiver 61-3 may be coupled to antenna 40-3 over transmission line 50-3, fourth transceiver 61-4 may be coupled to antenna 40-4 over transmission line 50-4, fifth transceiver 61-4 may be coupled to antenna 40-5 over transmission line 50-5, and sixth transceiver 61-4 may be coupled to antenna 40-6 over transmission line 50-6. This is merely illustrative and, if desired, two or more of antennas 40 may be coupled to different ports of the same transceiver.

Radio-frequency front end circuits 58 may be interposed on each transmission line 50 (e.g., a first front end circuit 58-1 may be interposed on transmission line 50-1, a second front end circuit 58-2 may be interposed on transmission line 50-2, a third front end circuit 58-3 may be interposed on transmission line 50-3, etc.). Front end circuits 58 may each include switching circuitry, filter circuitry (e.g., duplexer and/or diplexer circuitry, notch filter circuitry, low pass filter circuitry, high pass filter circuitry, bandpass filter circuitry, etc.), impedance matching circuitry for matching the impedance of transmission lines 50 to the corresponding antenna 40, networks of active and/or passive components such as tunable components 42 of FIG. 3, radio-frequency coupler circuitry for gathering antenna impedance measurements, amplifier circuitry (e.g., low noise amplifiers and/or power amplifiers) or any other desired radio-frequency circuitry. If desired, front end circuits 58 may include switching circuitry that is configured to selectively couple antennas 40-1, 40-2, 40-3, 40-4, 40-5, and 40-6 to different respective transceivers 61-1, 61-2, 61-3, 61-4, 61-5, and 61-6 (e.g., so that each antenna can handle communications for different transceivers 61 over time based on the state of the switching circuits in front end circuits 58).

If desired, front end circuits 58 may include filtering circuitry (e.g., duplexers and/or diplexers) that allow the corresponding antenna 40 to transmit and receive radio-frequency signals at the same time (e.g., using a frequency domain duplexing (FDD) scheme). Antennas 40-1, 40-2, 40-3, 40-4, 40-5, and 40-6 may transmit and/or receive radio-frequency signals in respective time slots or two or more of antennas 40-1, 40-2, 40-3, 40-4, 40-5, and 40-6 may transmit and/or receive radio-frequency signals concurrently. In general, any desired combination of transceivers 61-1, 61-2, 61-3, 61-4, 61-5, and 61-6 may transmit and/or receive radio-frequency signals using the corresponding antenna 40 at a given time. In one suitable arrangement, each of transceivers 61-1, 61-2, 61-3, 61-4, 61-5, and 61-6 may receive radio-frequency signals while a given one of transceivers 61-1, 61-2, 61-3, 61-4, 61-5, and 61-6 transmits radio-frequency signals at a given time.

Amplifier circuitry such as one or more power amplifiers may be interposed on transmission lines 50 and/or formed within radio-frequency transceiver circuitry 36 for amplifying radio-frequency signals output by transceivers 61 prior to transmission over antennas 40. Amplifier circuitry such as one or more low noise amplifiers may be interposed on transmission lines 50 and/or formed within radio-frequency transceiver circuitry 36 for amplifying radio-frequency signals received by antennas 40 prior to conveying the received signals to transceivers 61.

In the example of FIG. 4, separate front end circuits 58 are formed on each transmission line 50. This is merely illustrative. If desired, two or more transmission lines 50 may share the same front end circuits 58 (e.g., front end circuits 58 may be formed on the same substrate, module, or integrated circuit).

Each of transceivers 61 may, for example, include circuitry for converting baseband signals received from baseband processor 62 over paths 63 into corresponding radio-frequency signals. For example, transceivers 61 may each include mixer circuitry for up-converting the baseband signals to radio-frequencies prior to transmission over antennas 40. Transceivers 61 may include digital to analog converter (DAC) and/or analog to digital converter (ADC) circuitry for converting signals between digital and analog domains. Each of transceivers 61 may include circuitry for converting radio-frequency signals received from antennas 40 over transmission lines 50 into corresponding baseband signals. For example, transceivers 61 may each include mixer circuitry for down-converting the radio-frequency signals to baseband frequencies prior to conveying the baseband signals to baseband processor 62 over paths 63.

Each transceiver 61 may be formed on the same substrate, integrated circuit, or module (e.g., radio-frequency transceiver circuitry 36 may be a transceiver module having a substrate or integrated circuit on which each of transceivers 61 is formed) or two or more transceivers 61 may be formed on separate substrates, integrated circuits, or modules. Baseband processor 62 and front end circuits 58 may be formed on the same substrate, integrated circuit, or module as transceivers 61 or may be formed on separate substrates, integrated circuits, or modules from transceivers 61. In another suitable arrangement, radio-frequency transceiver circuitry 36 may include a single transceiver 61 having six ports, each of which is coupled to a respective transmission line 50, if desired. Each transceiver 61 may include transmitter and receiver circuitry for both transmitting and receiving radio-frequency signals. In another suitable arrangement, one or more transceivers 61 may perform only signal transmission or signal reception (e.g., one or more of transceivers 61 may be a dedicated transmitter or dedicated receiver).

In the example of FIG. 4, antennas 40-1 and 40-4 may occupy a larger space (e.g., a larger area or volume within device 10) than antennas 40-2, 40-3, 40-5, and 40-6. This may allow antennas 40-1 and 40-4 to support communications at longer wavelengths (i.e., lower frequencies) than antennas 40-2, 40-3, 40-5, and 40-6. This is merely illustrative and, if desired, each of antennas 40-1, 40-2, 40-3, 40-4, 40-5, and 40-6 may occupy the same volume or may occupy different volumes. Antennas 40-1, 40-2, 40-3, 40-4, 40-5, and/or 40-6 may be configured to convey radio-frequency signals in at least one common frequency band. If desired, one or more of antennas 40-1, 40-2, 40-3, 40-4, 40-5, and 40-6 may handle radio-frequency signals in at least one frequency band that is not covered by one or more of the other antennas in device 10.

If desired, each antenna 40 and each transceiver 61 may handle radio-frequency communications in multiple frequency bands (e.g., multiple cellular telephone communications bands). For example, transceiver 61-1, antenna 40-1, transceiver 61-4, and antenna 40-4, may handle radio-frequency signals in a first frequency band such as a cellular low band between 600 and 960 MHz, a second frequency band such as a cellular low-midband between 1410 and 1510 MHz, a third frequency band such as a cellular midband between 1700 and 2200 MHz, a fourth frequency band such as a cellular high band between 2300 and 2700 MHz, and/or a fifth frequency band such as a cellular ultra-high band between 3300 and 5000 MHz. Transceiver 61-2, antenna 40-2, transceiver 61-3, antenna 40-3, transceiver 61-5, antenna 40-5, transceiver 61-6, and antenna 40-6 may handle radio-frequency signals in some or all of these bands. In one suitable arrangement that is sometimes described herein as an example, antennas 40-1 and 40-4 may each convey radio-frequency signals in the cellular low band, the cellular low-midband, the cellular midband, the cellular high band, and the cellular ultra-high band, antennas 40-2 and 40-3 may each convey radio-frequency signals in the cellular midband, the cellular high band, and the cellular ultra-high band, and antennas 40-5 and 40-6 may each convey radio-frequency signals in the cellular ultra-high band (e.g., antennas 40-5 and 40-6 may occupy a smaller volume than antennas 40-2 and 40-3).

The example of FIG. 4 is merely illustrative. In general, antennas 40 may cover any desired frequency bands. Housing 12 may have any desired shape. Antennas 40 may be formed at any desired locations within housing 12. Forming each of antennas 40-1 through 40-6 at different corners and edges of housing 12 may, for example, maximize the multipath propagation of wireless data conveyed by antennas 40 to optimize overall data throughput for wireless communications circuitry 34.

When operating using a single antenna 40, a single stream of wireless data may be conveyed between device 10 and external communications equipment (e.g., one or more other wireless devices such as wireless base stations, access points, cellular telephones, computers, etc.). This may impose an upper limit on the data rate (data throughput) obtainable by wireless communications circuitry 34 in communicating with the external communications equipment. As software applications and other device operations increase in complexity over time, the amount of data that needs to be conveyed between device 10 and the external communications equipment typically increases, such that a single antenna 40 may not be capable of providing sufficient data throughput for handling the desired device operations.

In order to increase the overall data throughput of wireless communications circuitry 34, multiple antennas 40 may be operated using a multiple-input and multiple-output (MIMO) scheme. When operating using a MIMO scheme, two or more antennas 40 on device 10 may be used to convey multiple independent streams of wireless data at the same frequency. This may significantly increase the overall data throughput between device 10 and the external communications equipment relative to scenarios where only a single antenna 40 is used. In general, the greater the number of antennas 40 that are used for conveying wireless data under the MIMO scheme, the greater the overall throughput of wireless communications circuitry 34.

In order to perform wireless communications under a MIMO scheme, antennas 40 need to convey data at the same frequencies. If desired, wireless communications circuitry 34 may perform so-called two-stream (2×) MIMO operations (sometimes referred to herein as 2× MIMO communications or communications using a 2×MIMO scheme) in which two antennas 40 are used to convey two independent streams of radio-frequency signals at the same frequency. Wireless communications circuitry 34 may perform so-called four-stream (4×) MIMO operations (sometimes referred to herein as 4×MIMO communications or communications using a 4×MIMO scheme) in which four antennas 40 are used to convey four independent streams of radio-frequency signals at the same frequency. Performing 4×MIMO operations may support higher overall data throughput than 2×MIMO operations because 4×MIMO operations involve four independent wireless data streams whereas 2×MIMO operations involve only two independent wireless data streams. If desired, antennas 40-1, 40-2, 40-3, 40-4, 40-5, and 40-6 may perform 2×MIMO operations in some frequency bands and may perform 4× MIMO operations in other frequency bands (e.g., depending on which bands are handled by which antennas). Antennas 40-1, 40-2, 40-3, 40-4, 40-5, and 40-6 may perform 2×MIMO operations in some bands concurrently with performing 4×MIMO operations in other bands, for example.

As one example, antennas 40-1 and 40-4 (and the corresponding transceivers 61-1 and 61-4) may perform 2×MIMO operations by conveying radio-frequency signals at the same frequency in a cellular low band between 600 MHz and 960 MHz. At the same time, antennas 40-1, 40-2, 40-3, and 40-4 may collectively perform 4×MIMO operations by conveying radio-frequency signals at the same frequency in a cellular midband between 1700 and 2200 MHz, at the same frequency in a cellular high band (HB) between 2300 and 2700 MHz, and/or at the same frequency in a cellular ultra-high band (UHB) between 3300 and 5000 MHz (e.g., antennas 40-1 and 40-4 may perform 2×MIMO operations in the low band concurrently with performing 4×MIMO operations in the midband, high band, and/or ultra-high band).

In practice, there may be some scenarios where antennas 40-1, 40-2, 40-3, and 40-4 are not configured to convey radio-frequency signals in the cellular ultra-high band (e.g., when antennas 40-1, 40-2, 40-3, and 40-4 are tuned or switched to handle other frequency bands away from the cellular ultra-high band). In these scenarios, antennas 40-5 and 40-6 may perform 2× MIMO operations in the cellular ultra-high band. There may be other scenarios in which antennas 40-2 and 40-3 are covering the cellular ultra-high band whereas antennas 40-1 and 40-4 are not handling the cellular ultra-band. In these scenarios, antennas 40-5 and 40-6 may also cover the cellular ultra-high band so that antennas 40-2, 40-3, 40-5, and 40-6 collectively perform 4×MIMO operations in the cellular ultra-high band. In other words, the presence of antennas 40-5 and 40-6 may help to ensure that device 10 is always able to perform at least 2× MIMO operations in the cellular ultra-high band regardless of the states of antennas 40-1, 40-2, 40-3, and 40-4. This example is merely illustrative and, in general, any desired number of antennas may be used to perform any desired MIMO operations in any desired frequency bands.

If desired, wireless communications circuitry 34 may convey wireless data with multiple antennas on one or more external devices (e.g., multiple wireless base stations) in a scheme sometimes referred to as carrier aggregation. When operating using a carrier aggregation scheme, the same antenna 40 may convey radio-frequency signals with multiple antennas (e.g., antennas on different wireless base stations) at different respective frequencies (sometimes referred to herein as carrier frequencies, channels, carrier channels, or carriers). For example, antenna 40-1 may receive radio-frequency signals from a first wireless base station at a first frequency, from a second wireless base station at a second frequency, and a from a third base station at a third frequency. The received signals at different frequencies may be simultaneously processed (e.g., by transceiver 61-1) to increase the communications bandwidth of transceiver 61-1, thereby increasing the data rate of transceiver 61-1. Similarly, antennas 40-1, 40-2, 40-3, 40-4, 40-5, and 40-6 may perform carrier aggregation at two, three, or more than three frequencies within any desired frequency bands. This may serve to further increase the overall data throughput of wireless communications circuitry 34 relative to scenarios where no carrier aggregation is performed. For example, the data throughput of wireless communications circuitry 34 may increase for each carrier frequency that is used (e.g., for each wireless base station that communicates with each of antennas 40-1, 40-2, 40-3, 40-4, 40-5, and 40-6).

By performing communications using both a MIMO scheme and a carrier aggregation scheme, the data throughput of wireless communications circuitry 34 may be even greater than in scenarios where either a MIMO scheme or a carrier aggregation scheme is used. The data throughput of wireless communications circuitry 34 may, for example, increase for each carrier frequency that is used by antennas 40 (e.g., each carrier frequency may contribute 40 megabits per second (Mb/s) or some other throughput to the total throughput of wireless communications circuitry 34). The example of FIG. 4 is merely illustrative. If desired, antennas 40 may cover any desired number of frequency bands at any desired frequencies. More than six antennas 40 or fewer than six antennas 40 may perform MIMO and/or carrier aggregation operations at non-near-field communications frequencies if desired.

Figure 5:
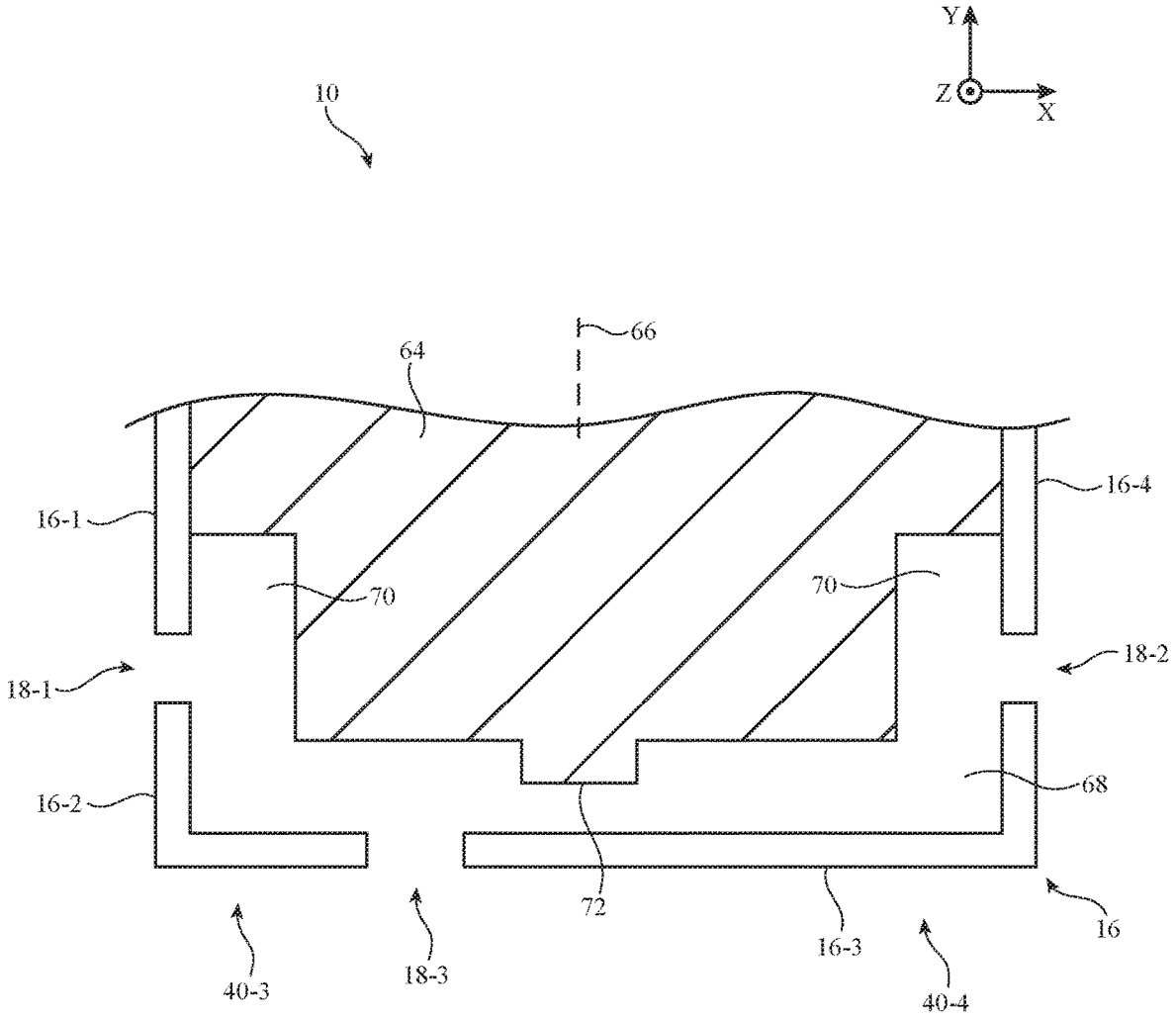
FIG. 5 is a top view of illustrative antennas formed from housing structures in an electronic device in accordance with some embodiments.

A top interior view of an illustrative portion of device 10 that contains antennas 40-4 and 40-3 of FIG. 4 is shown in FIG. 5. In the example of FIG. 5, antennas 40-3 and 40-4 are each formed using hybrid slot-inverted-F antenna structures. As shown in FIG. 5, peripheral conductive housing structures 16 may be segmented (divided) by dielectric-filled gaps 18 (e.g., plastic gaps) such as a first gap 18-1, a second gap 18-2, and a third gap 18-3. Each of gaps 18-1, 18-2, and 18-3 may be formed within peripheral structures 16 along respective sides of device 10. For example, gap 18-1 may be formed at a first side of device 10 and may separate a first segment 16-1 of peripheral conductive housing structures 16 from a second segment 16-2 of peripheral conductive housing structures 16. Gap 18-3 may be formed at a second side of device 10 and may separate second segment 16-2 from a third segment 16-3 of peripheral conductive housing structures 16. Gap 18-2 may be formed at a third side of device 10 and may separate third segment 16-3 from a fourth segment 16-4 of peripheral conductive housing structures 16.

The resonating element for antenna 40-4 may include an inverted-F antenna resonating element arm that is formed from segment 16-3. The resonating element for antenna 40-3 may include an inverted-F antenna resonating element arm that is formed from segment 16-2. Air and/or other dielectric may fill slot 68 between arm segments 16-2 and 16-3 and ground structures 64. Ground structures 64 may include one or more planar metal layers such as a metal layer used to form a rear housing wall for device 10, a metal layer that forms an internal support structure for device 10, conductive traces on a printed circuit board, and/or any other desired conductive layers in device 10. Ground structures 64 may extend from segment 16-1 to segment 16-4 of peripheral conductive housing structures 16. Ground structures 64 may be coupled to segments 16-1 and 16-4 using conductive adhesive, solder, welds, conductive screws, conductive pins, and/or any other desired conductive interconnect structures. If desired, ground structures 64 and segments 16-1 and 16-4 may be formed from different portions of a single integral conductive structure (e.g., a conductive housing for device 10).

Ground structures 64 need not be confined to a single plane and may, if desired, include multiple layers located in different planes or non-planar structures. Ground structures 64 may include conductive (e.g., grounded) portions of other electrical components within device 10. For example, ground structures 64 may include conductive portions of display 14 (FIG. 1). Conductive portions of display 14 may include a metal frame for display 14, a metal backplate for display 14, shielding layers or shielding cans for display 14, pixel circuitry in display 14, touch sensor circuitry (e.g., touch sensor electrodes) for display 14, and/or any other desired conductive structures in display 14 or used for mounting display 14 to the housing for device 10.

Ground structures 64 and segments 16-1 and 16-4 may form portions of the antenna ground for antennas 40-1, 40-2, 40-3, 40-4, 40-5, and/or 40-6 (FIG. 4). If desired, slot 68 may be configured to form slot antenna resonating element structures that contribute to the overall performance of antennas 40-3 and/or 40-4. Slot 68 may extend from gap 18-1 to gap 18-2 (e.g., the ends of slot 68 which may sometimes be referred to as open ends, may be formed by gaps 18-1 and 18-2). Slot 68 may have an elongated shape having any suitable length (e.g., about 4-20 cm, more than 2 cm, more than 4 cm, more than 8 cm, more than 12 cm, less than 25 cm, less than 10 cm, etc.) and any suitable width (e.g., approximately 2 mm, less than 2 mm, less than 3 mm, less than 4 mm, 1-3 mm, etc.). Gap 18-3 may be continuous with and extend perpendicular to a portion of slot 68 along the longitudinal axis of the longest portion of slot 68 (e.g., the portion of slot 68 extending parallel to the X-axis of FIG. 7). If desired, slot 68 may include vertical portions 70 that extend parallel to longitudinal axis 66 (e.g., the Y-axis of FIG. 7) and beyond gaps 18-1 and 18-2.

As shown in FIG. 5, a portion 72 of ground structures 64 may protrude into slot 68 towards segment 16-3. Portion 72 of ground structures 64 (sometimes referred to herein as protrusion 72, ground protrusion 72, extension 72, or ground extension 72) may be located closer to segment 16-3 than other portions of ground structures 64 (e.g., ground extension 72 may extend parallel to longitudinal axis 66 towards segment 16-3). Ground extension 72 may, for example, support components for display 14 of FIG. 1 (e.g., components that allow active area AA of display 14 to extend across substantially all of the front face of device 10). If desired, ground extension 72 may form a distributed capacitance with segment 16-3 that tunes the frequency response of antenna 40-4.

Slot 68 may be filled with dielectric such as air, plastic, ceramic, or glass. For example, plastic may be inserted into portions of slot 68 and this plastic may be flush with the exterior of the housing for device 10. Dielectric material in slot 68 may lie flush with dielectric material in gaps 18-1, 18-2, and 18-3 at the exterior of the housing 12 if desired. The example of FIG. 7 in which slot 68 has a U-shape is merely illustrative. If desired, slot 68 may have any other desired shapes (e.g., a rectangular shape, meandering shapes having curved and/or straight edges, etc.).

Antennas 40-5 and 40-6 (FIG. 4) may be formed between segments 16-1 and 16-4 and ground structures 64 and may convey radio-frequency signals within the cellular ultra-high band. The presence of display 14 (FIG. 1) may confine antennas 40-5 and 40-6 to relatively small volumes. It can therefore be challenging for antennas 40-5 and 40-6 to cover the entirety of the cellular ultra-high band with satisfactory antenna efficiency. In order to cover as much of the cellular ultra-high band as possible, antennas 40-5 and 40-6 may be multi-band antennas that have multiple resonances (response peaks) at different frequencies within the cellular ultra-high band. In one suitable arrangement that is sometimes described herein as an example, antennas 40-5 and 40-6 may each include monopole antenna resonating elements and slot antenna resonating elements that exhibit different response peaks for covering the entire cellular ultra-high band.

Figure 6:
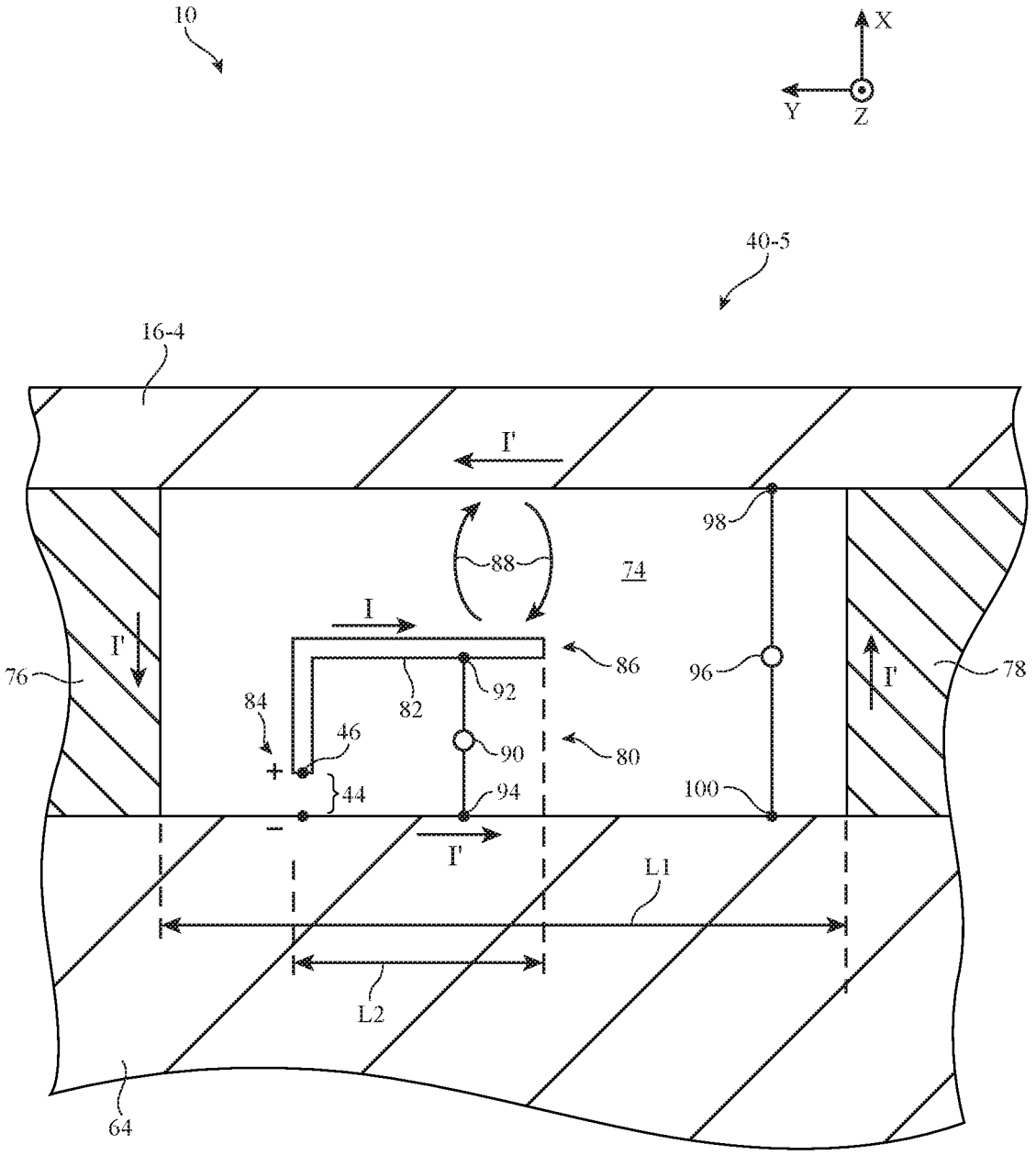
FIG. 6 is a top view of an illustrative multi-band antenna having a monopole element that indirectly feeds a slot element in accordance with some embodiments.

FIG. 6 is a top view of an illustrative antenna 40-5 that includes both monopole and slot elements (e.g., at the right edge of device 10 as shown in FIG. 4). Similar structures may also be used to form antenna 40-6 of FIG. 4.

As shown in FIG. 6, antenna 40-5 may include an opening such as slot 74 that is formed between segment 16-4 of the peripheral conductive housing structures for device 10, ground structures 64, conductive interconnect structure 76, and conductive interconnect structure 78 (e.g., a closed slot 74 having all edges defined by conductive material). Conductive interconnect structures 76 and 78 may couple ground structures 64 to segment 16-4. Conductive interconnect structures 76 and 78 may include conductive portions of components for device 10, conductive tape or other adhesives, sheet metal, integral portions of segment 16-4, integral portions of ground structures 64, conductive clips, conductive foam, conductive springs, solder, welds, conductive traces on underlying substrates, metal foil, conductive portions of display 14 (FIG. 1), other conductive portions of the housing for device 10 (e.g., housing 12 of FIG. 1), wire, and/or any other desired conductive structures that help to define edges of slot 74.

Slot 74 may be filled with air, plastic, and/or other dielectrics. The shape of slot 74 may be straight or may have one or more bends (e.g., slot 74 may have an elongated shape following a meandering path). In the example of FIG. 6, slot 74 has a rectangular shape with a length L1 and a perpendicular width (e.g., parallel to the X-axis) that is less than length L1. Slot 74 may sometimes be referred to herein as slot element 74, slot antenna resonating element 74, slot antenna radiating element 74, or slot radiating element 74. Slot-based radiating elements such as slot 74 of FIG. 6 may give rise to an antenna resonance at frequencies in which the wavelength of the antenna signals is approximately equal to the perimeter of the slot (e.g., an effective wavelength that is modified by a constant value based on the dielectric properties of the material within slot 74). In narrow slots, the resonant frequency of the slot is associated with signal frequencies at which the slot length is approximately equal to a half of a wavelength of operation.

Antenna 40-5 may also include a monopole antenna resonating (radiating) element within slot 74 such as monopole element 80. Monopole element 80 may include resonating element arm 82 (e.g., a monopole antenna resonating element arm) formed within and/or overlapping slot 74. Monopole element 80 may include an antenna feed 44 coupled between ground structures 64 and resonating element arm 82. For example, positive antenna feed terminal 46 of antenna feed 44 may be coupled to end 84 of resonating element arm 82, whereas ground antenna feed terminal 48 is coupled to ground structures 64 (e.g., monopole element 82 may be directly fed by antenna feed 44). Resonating element arm 82 may sometimes also be referred to herein as monopole arm 82, monopole radiating element 82, radiating element 82, or radiating arm 82.

Resonating element arm 82 may extend from end 84 to tip 86. Tip 86 may be located at or near (e.g., within 20% of length L1 from) the center of slot 74. Resonating element arm 82 may have a length L2 that determines the resonant frequency of monopole element 80. Length L2 may, for example, be approximately equal to one-quarter of the wavelength of operation of monopole element 80 (e.g., an effective wavelength of operation that accounts for the dielectric material surrounding resonating element arm 82).

Monopole element 80 may radiate radio-frequency signals to contribute to the frequency response of antenna 40-5 and may serve as an indirect antenna feed for slot 74 (e.g., monopole element 80 may be directly fed radio-frequency signals via antenna feed 44 and may indirectly feed slot 74). For example, during signal transmission, radio-frequency signals may be provided to antenna feed 44 by radio-frequency transceiver circuitry 36 (FIG. 3). The radio-frequency signals on antenna feed 44 may produce corresponding antenna currents I on resonating element arm 82. Antenna currents I on resonating element arm 82 may radiate radio-frequency signals in a first frequency band associated with monopole element 80 (e.g., a frequency band as determined by length L2). At the same time, antenna currents I may indirectly feed slot 74 by inducing antenna currents I' to flow along the perimeter of slot 74 via near-field (e.g., capacitive) electromagnetic coupling 88. Antenna currents I' may flow through segment 16-4, conductive interconnect structures 76 and 78, and ground structures 64 and may radiate radio-frequency signals in a second frequency band associated with slot 74 (e.g., a frequency band as determined by the perimeter of slot 74 and/or length L1).

During signal reception, radio-frequency signals in the second frequency band may be received by antenna 40-5 and may produce antenna currents I' around slot 74. Currents I' may contribute to antenna currents I on monopole element 80 via near-field electromagnetic coupling 88. At the same time, radio-frequency signals in the first frequency band may be received by antenna 40-5 and may contribute to antenna currents I on resonating element arm 82. Radio-frequency signals corresponding to antenna currents I may be provided to radio-frequency transceiver circuitry 36 (FIG. 3) via antenna feed 44.

The electric field produced by slot 74 may extend parallel to the X-axis of FIG. 6. Placing tip 96 at or near the center of slot 74 may maximize near-field electromagnetic coupling between monopole element 80 and slot 74 (e.g., due to the high-magnitude electric field produced by monopole element 80 at tip 86 and the high-magnitude electric field produced by slot 74 at the center of the slot in its fundamental mode). Resonating element arm 82 and tip 86 may extend parallel to length L1 of slot 74 (e.g., parallel to the Y-axis of FIG. 6). This may serve to mitigate cancellation between currents I and I', because resonating element arm 82 extends perpendicular to the direction of the electric field produced by slot 74.

The dimensions of monopole element 80 and slot 74 may be selected to tune the frequency response of antenna 40-5. For example, length L2 may be selected to be approximately (e.g., within 20% of) one-quarter of a first (effective) wavelength of operation for antenna 40-5. Length L1 may be selected to be approximately (e.g., within 20% of) one-half of a second (effective) wavelength of operation for antenna 40-5. The first and second wavelengths may be selected so that monopole element 80 and slot 74 collectively cover all of the cellular ultra-high band (e.g., so that antenna 40-5 conveys radio-frequency signals at frequencies between 3300 MHz and 5000 MHz with an antenna efficiency that exceeds a threshold antenna efficiency).

If desired, antenna 40-5 may include adjustable components 90 and/or 96 (e.g., tunable components such as tunable components 42 of FIG. 3). As shown in FIG. 6, adjustable component 90 may have a first terminal 92 coupled to resonating element arm 82 and a second terminal 94 coupled to ground structures 64. Adjustable component 96 may have a first terminal 98 coupled to segment 16-4 and a second terminal 100 coupled to ground structures 64 (e.g., adjustable component 96 may be coupled across slot 74). Adjustable component 90 may be adjusted (e.g., using control signals provided by control circuitry 28 over path 56 of FIG. 3) to tune the first wavelength of operation of antenna 40-5. Adjustable component 96 may be adjusted (e.g., using control signals provided by control circuitry 28 over path 56 of FIG. 3) to tune the second wavelength of operation of antenna 40-5. Adjusting components 96 and 90 may help antenna 40-5 to cover the entirety of the cellular ultra-high band in scenarios where monopole element 80 and slot 74 do not exhibit sufficient bandwidth on their own to cover all of the cellular ultra-high band. In another suitable arrangement, adjustable components 96 and 90 may include fixed tuning components that help tune the frequency response of antenna 40-5.

The example of FIG. 6 is merely illustrative. If desired, antenna 40-5 may include additional adjustable components coupled between any desired edges of slot 74 and/or between any desired edges of slot 74 and monopole element 80. Slot 74 may have other shapes (e.g., shapes having any desired number of curved and/or straight edges). Similar structures may be used to form antenna 40-6 of FIG. 4.

Figure 7:
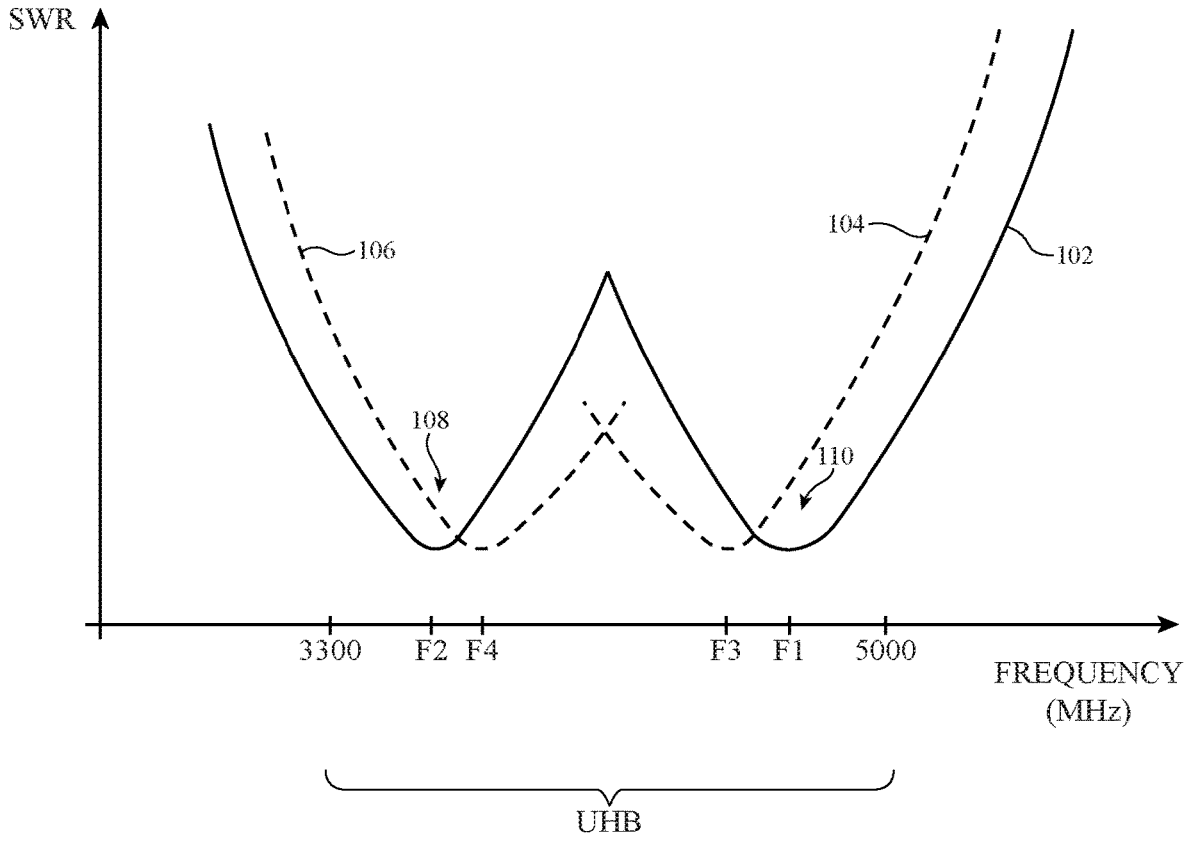
FIG. 7 is a plot of antenna performance (standing wave ratio) of an illustrative antenna of the type shown in FIG. 6 in accordance with some embodiments.

FIG. 7 is a graph in which antenna performance (standing wave ratio) has been plotted as a function of operating frequency for antenna 40-5 of FIG. 6. As shown in FIG. 7, curve 102 plots an exemplary frequency response of antenna 40-5. As shown by curve 102, antenna 40-5 may exhibit a first response peak 110 at frequency F1. Response peak 110 may be produced by monopole element 80 of FIG. 6 (e.g., frequency F1 may be the frequency corresponding to the first wavelength of operation of antenna 40-5 and may be determined by length L2 of resonating element arm 82). Antenna 40-5 may exhibit a second response peak 108 at frequency F2. Response peak 108 may be produced by slot 74 of FIG. 6 (e.g., frequency F2 may be the frequency corresponding to the second wavelength of operation of antenna 40-5 and may be determined by length L1 of slot 74).

As shown in FIG. 7, frequencies F1 and F2 lie within the cellular ultra-high band (UHB) between 3300 MHz and 5000 MHz. As shown by curve 102, response peaks 108 and 110 may not exhibit sufficient bandwidth to cover each frequency within cellular ultra-high band. If desired, adjustable component 96 of FIG. 6 may be adjusted to tune second response peak 108 from frequency F2 to another frequency within cellular ultra-high band UHB such as frequency F4 (e.g., as shown by dashed curve 106). Similarly, if desired, adjustable component 90 of FIG. 6 may be adjusted to tune first response peak 110 from frequency F1 to another frequency within cellular ultra-high band UHB such as frequency F3 (e.g., as shown by dashed curve 104). In this way, antenna 40-5 may be adjusted to cover any desired frequencies within cellular ultra-high band UHB (e.g., to tune antenna 40-5 between different bands (channels) within frequency band UHB such as between the N77, N78, and N79 5G bands).

Figure 8:
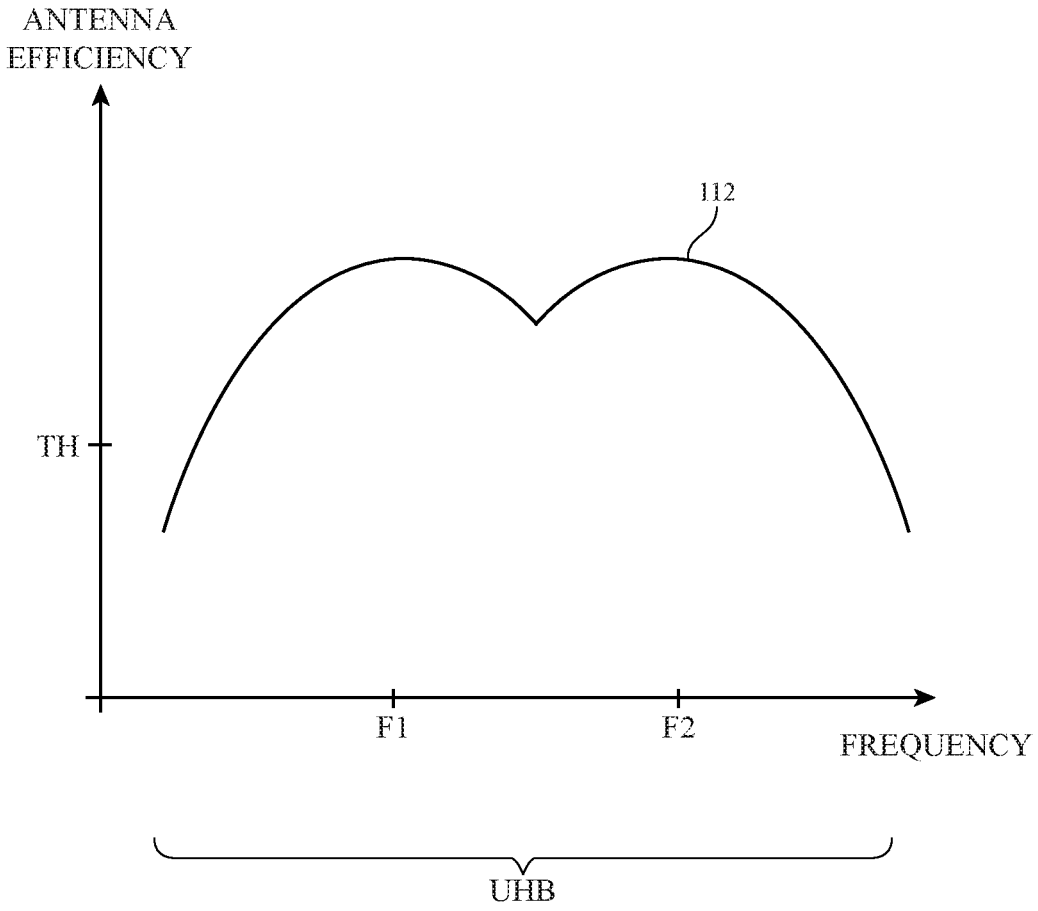
FIG. 8 is a plot of antenna performance (antenna efficiency) of an illustrative antenna of the type shown in FIG. 6 in accordance with some embodiments.

This may allow monopole element 80 and slot 74 (antenna 40-5) to collectively exhibit a satisfactory antenna efficiency across the cellular ultra-high band, as shown in FIG. 8. Curve 112 of FIG. 8 plots the antenna efficiency of antenna 40-5 of FIG. 6 as a function of frequency. As shown by curve 112, antenna 40-5 may exhibit multiple response peaks at frequencies F1 and F2 (or any other frequencies within cellular ultra-high band UHB) from the contributions of both monopole element 80 and slot 74. Collectively, monopole element 80 and slot 74 may exhibit an antenna efficiency that exceeds threshold value TH across the entirety of cellular ultra-high band UHB.

The examples of FIGS. 7 and 8 are merely illustrative. In general, antenna 40-5 may cover any desired bands at any desired frequencies (e.g., antenna 40-5 may exhibit any desired number of response peaks extending over any desired frequency bands). Curves 102, 106, and 104 of FIG. 7 and curve 112 of FIG. 8 may have other shapes if desired.

Figure 9:
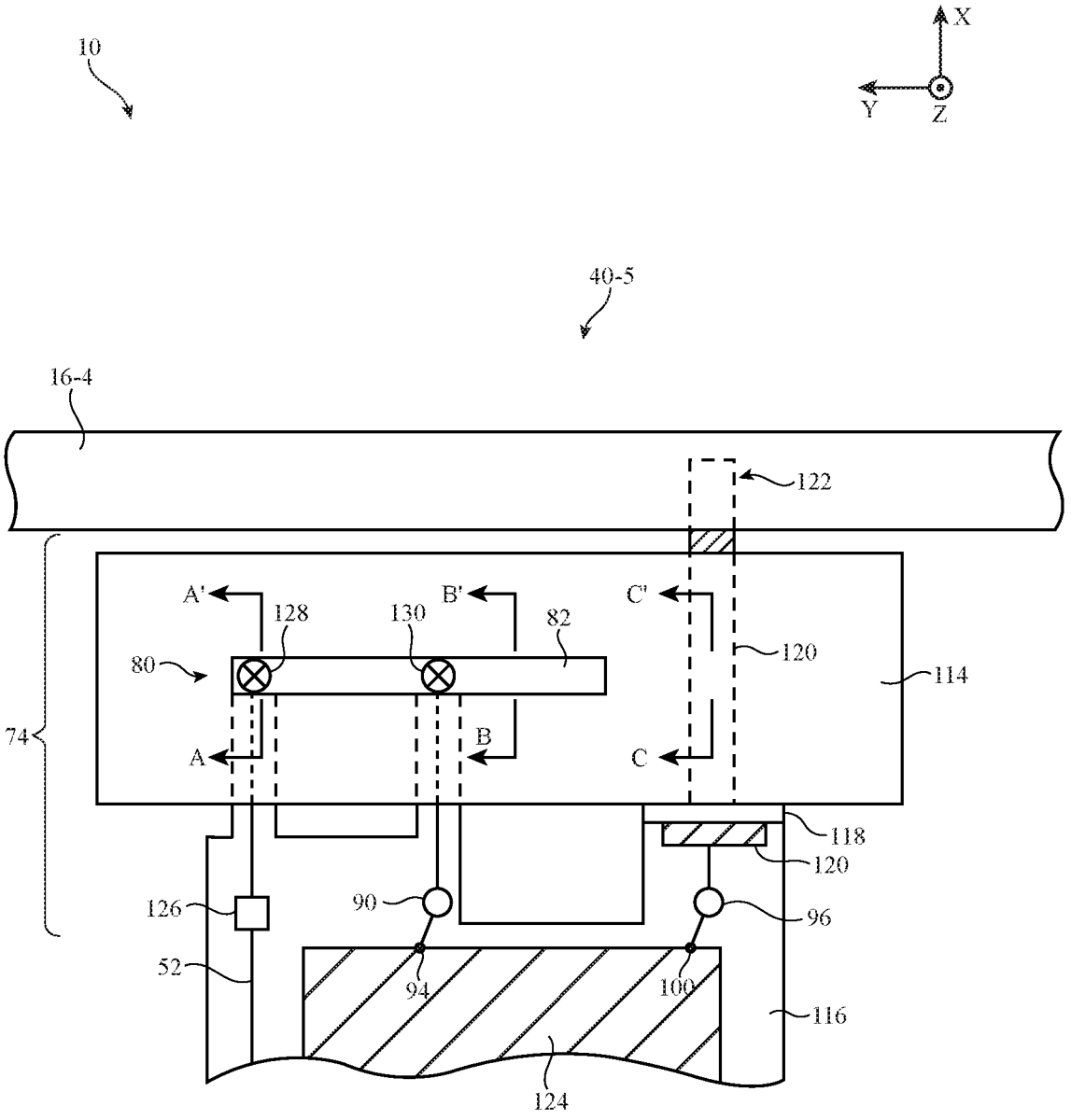
FIG. 9 is a top view showing how an illustrative antenna of the type shown in FIG. 6 may be integrated into an electronic device in accordance with some embodiments.

FIG. 9 is a top view showing how antenna 40-5 may be integrated within device 10. In the example of FIG. 9, conductive interconnect structures 76 and 78 and ground structures 64 of FIG. 6 have been omitted for the sake of clarity.

As shown in FIG. 9, resonating element arm 82 of monopole element 80 may be embedded within, formed on a surface of, or may otherwise overlap a dielectric substrate such as dielectric support structure 114. Dielectric support structure 114 may include plastic, foam, ceramic, or any other desired dielectric materials. If desired, dielectric support structure 114 may help to provide mechanical support for segment 16-4 of the peripheral conductive housing structures for device 10 or for other components in device 10 (e.g., display 14 of FIG. 1). Monopole element 80 may be fed using structures on a printed circuit such as flexible printed circuit 116.

Antenna 40-5 may be fed using a transmission line (e.g., transmission line 50 of FIG. 3) having signal conductor 52 on flexible printed circuit 116 (e.g., a printed circuit having a flexible printed circuit substrate such as a polyimide substrate). Impedance matching structures such as impedance matching structures 126 may be coupled to signal conductor 52 to help match the impedance of monopole element 80 to the impedance of the transmission line and/or to help tune the frequency response of antenna 40-5. Ground traces such as ground traces 124 may be formed on one or more surfaces and/or may be embedded within flexible printed circuit 116. Ground traces 124 may form part of ground structures 64 of FIG. 6 if desired (e.g., ground traces 124 may form part of the antenna ground for antenna 40-5). Ground traces 124 may be grounded (shorted) to a metal support plate, conductive display structures, and/or any other desired ground structures in device 10 using conductive screws, pins, solder, welds, conductive adhesive, conductive clips, and/or any other desired conductive interconnect structures at any desired locations on ground traces 124 (e.g., at terminals 94 and/or 100).

As shown in FIG. 9, signal conductor 52 on flexible printed circuit 116 may be coupled to resonating element arm 82 using conductive screw 128 (e.g., at positive antenna feed terminal 46 of FIG. 6). Conductive screw 128 may extend through some, all, or none of dielectric support structure 114. Solder, welds, conductive adhesive, a conductive screw boss, or other structures may additionally or alternatively be used to help couple signal conductor 52 to resonating element arm 82.

Adjustable components 90 and 96 for antenna 40-5 may be formed on flexible printed circuit 116 (e.g., using surface mount technology, conductive traces in or on flexible printed circuit 116, etc.). Terminal 94 of adjustable component 90 and terminal 100 of adjustable component 90 may be coupled to ground traces 124. Adjustable component 90 may be coupled to resonating element arm 82 using conductive screw 130 (e.g., at terminal 92 of FIG. 6). Conductive screw 130 may extend through some, all, or none of dielectric support structure 114. Solder, welds, conductive adhesive, a conductive screw boss, or other structures may additionally or alternatively be used to help couple adjustable component 90 to resonating element arm 82.

Adjustable component 96 may be coupled to segment 16-4 (e.g., across slot 74) using conductive screw 120 (e.g., at terminal 98 of FIG. 6). Conductive screw 120 may extend through some, all, or none of dielectric support structure 114. Conductive screw 120 may be received by threaded hole 122 on segment 16-4 or other receiving structures on segment 16-4. Solder, welds, conductive adhesive, a conductive screw boss, or other structures may additionally or alternatively be used to help couple adjustable component 96 to segment 16-4. Flexible printed circuit 116 may include an extension 118 that is interposed between the head of conductive screw 120 and dielectric support structure 114 if desired. Conductive traces for adjustable component 96 may be formed on extension 118 and may be shorted to segment 16-4 via conductive screw 120. Conductive screws 120, 128, and/or 130 may help to mechanically secure dielectric support structure 114 in place if desired.

Figure 10:
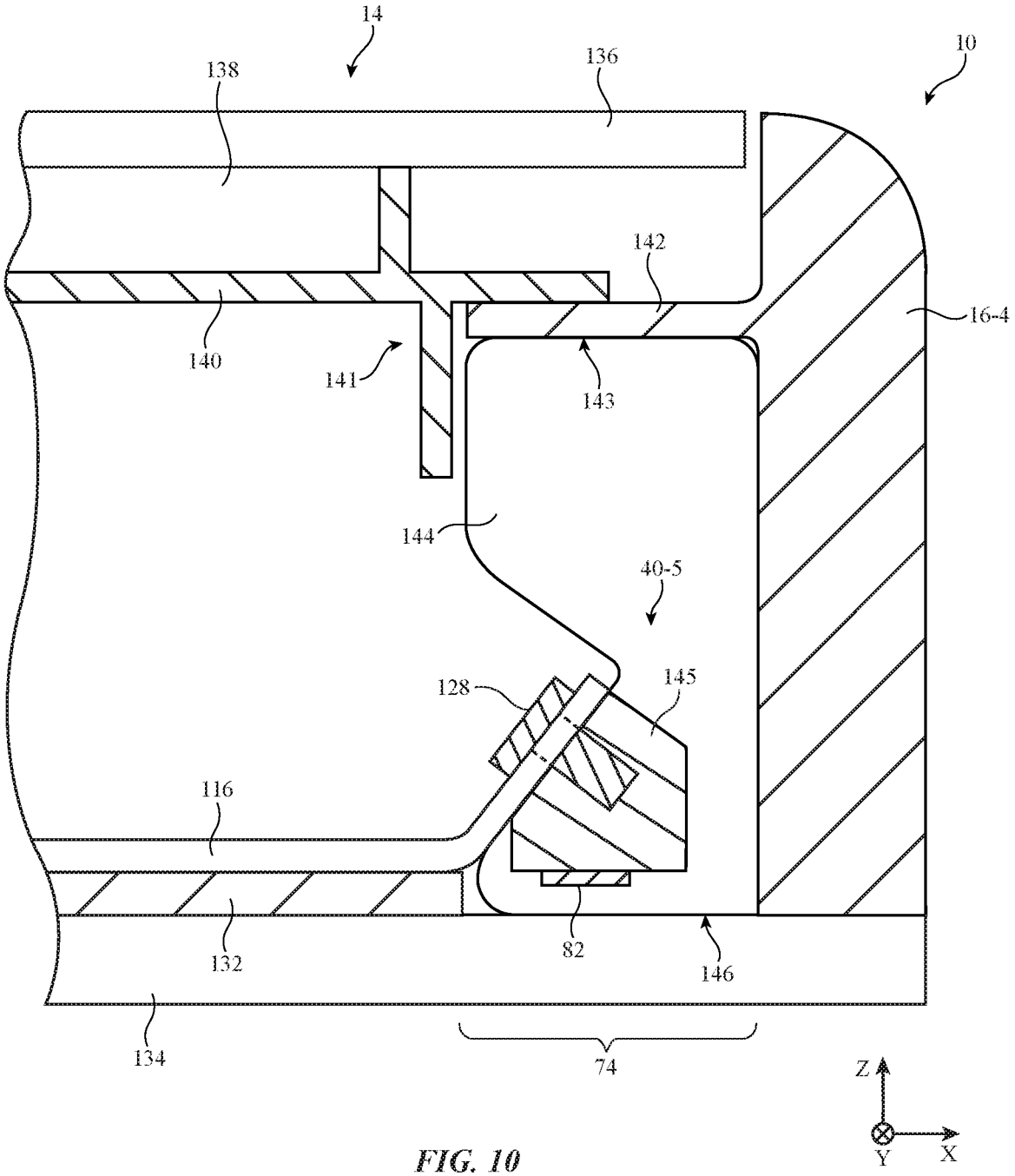
FIG. 10 is a cross-sectional side view showing how an illustrative antenna of the type shown in FIG. 6 may be fed using a flexible printed circuit in accordance with some embodiments.

FIG. 10 is a cross-sectional side view showing how flexible printed circuit 116 may be coupled to resonating element arm 82 of antenna 40-5 (e.g., as taken in the direction of line AA' of FIG. 9). As shown in FIG. 10, device 10 may include a conductive support plate such as conductive support plate 132. Conductive support plate 132 may, for example, form a part of ground structures 64 (FIG. 6) and housing 12 (FIG. 1). Dielectric cover layer 134 may be layered under conductive support plate 132. Dielectric cover layer 134 may be formed from plastic, glass, sapphire, ceramic, a dielectric coating, or any other dielectric material. Dielectric cover layer 134 and conductive support plate 132 may, for example form a rear housing wall for device 10.

Display 14 may include display module 138 and display cover layer 136. Display module 138 (sometimes referred to herein as display panel 138) may include pixel circuitry, touch sensor circuitry, force sensor circuitry, or any other circuitry that emits light through display cover layer 136 and/or that receives touch or force input through display cover layer 136 (e.g., display module 138 may form active area AA of FIG. 1). Display cover layer 136 may be formed from sapphire, glass, plastic, or any other desired transparent material. Display cover layer 136 may extend across the length and width of device 10 and may cover substantially all of the front face of device 10. Portions of display cover layer 136 may be provided with an opaque masking layer, ink, or pigment to help hide components within device 10 from view. Display 14 may include conductive display frame 140. Conductive display frame 140 may help to hold display 14 in place on device 10. Conductive display frame 140 and/or conductive portions of display module 138 may form part of ground structures 64 of FIG. 6 if desired.

Segment 16-4 of the peripheral conductive housing structures for device 10 may extend from dielectric cover layer 134 to display cover layer 136. Segment 16-4 may include conductive ledge 142 (sometimes referred to herein as conductive datum 142). Conductive display frame 140 may include fastening structures 141 (e.g., clips, snaps, pins, springs, etc.) that help to mechanically secure display 14 to conductive ledge 142 or other portions of segment 16-4. Segment 16-4 may be separated from conductive support plate 132 by slot 74. If desired, one or more openings may be formed in conductive display frame 140 and/or conductive ledge 142 overlapping slot 74 so that antenna 40-5 is able to convey radio-frequency signals through display 14 and the front face of device 10.

Dielectric support structure 144 may be formed within and/or overlapping slot 74 and may extend from dielectric cover layer 134 to conductive display frame 140 and conductive ledge 142. Dielectric support structure 144 may, for example, form some or all of dielectric support structure 114 of FIG. 9. Dielectric support structure 144 of FIG. 10 may help to provide mechanical support for display 14 (e.g., conductive display frame 140), conductive ledge 142, and/or segment 16-4 (e.g., upper surface 143 of dielectric support structure 144 may contact conductive ledge 142 and/or conductive display frame 140). Dielectric support structure 144 may, if desired, contact upper surface 146 of dielectric cover layer 134 within some or all of slot 74.

As shown in FIG. 10, a conductive screw boss such as screw boss 145 may be formed on or within dielectric support structure 144. Dielectric support structure 144 may, for example, be molded over screw boss 145. Resonating element arm 82 for antenna 40-5 may be coupled to screw boss 145. Flexible printed circuit 116 may run along conductive support plate 132. Conductive screw 128 may extend through flexible printed circuit 116 and may be received by a threaded screw hole on screw boss 145. Conductive screw 128 may help to secure flexible printed circuit 116 in place and may electrically couple the signal conductor on flexible printed circuit (e.g., signal conductor 52 of FIG. 9) to resonating element arm 82 via screw boss 145. Similar structures may be used to couple adjustable component 90 of FIG. 9 to resonating element arm 82. Ground traces on flexible printed circuit 116 (e.g., ground traces 124 of FIG. 9) may be shorted to conductive support plate 132 using screws or other interconnect structures at one or more locations (e.g., at ground antenna feed terminal 48 of FIG. 6, terminals 94 and 100 of FIG. 9, etc.). The ground traces on flexible printed circuit 116 may also be coupled to conductive display frame 140 at one or more locations (not shown in the example of FIG. 10 for the sake of clarity).

In this way, flexible printed circuit 116 (e.g., signal conductor 52 of FIG. 9) may convey radio-frequency signals to and from resonating element arm 82. Antenna currents on resonating element arm 82 (e.g., antenna currents I of FIG. 6) may induce antenna currents (e.g., antenna currents I' of FIG. 6) on conductive support plate 132 and segment 16-4. Resonating element arm 82 and slot 74 may radiate the radio-frequency signals through the rear face of device 10 (e.g., through dielectric cover layer 134) and/or through the front face of device 10 (e.g., through display cover layer 136).

Figure 11:
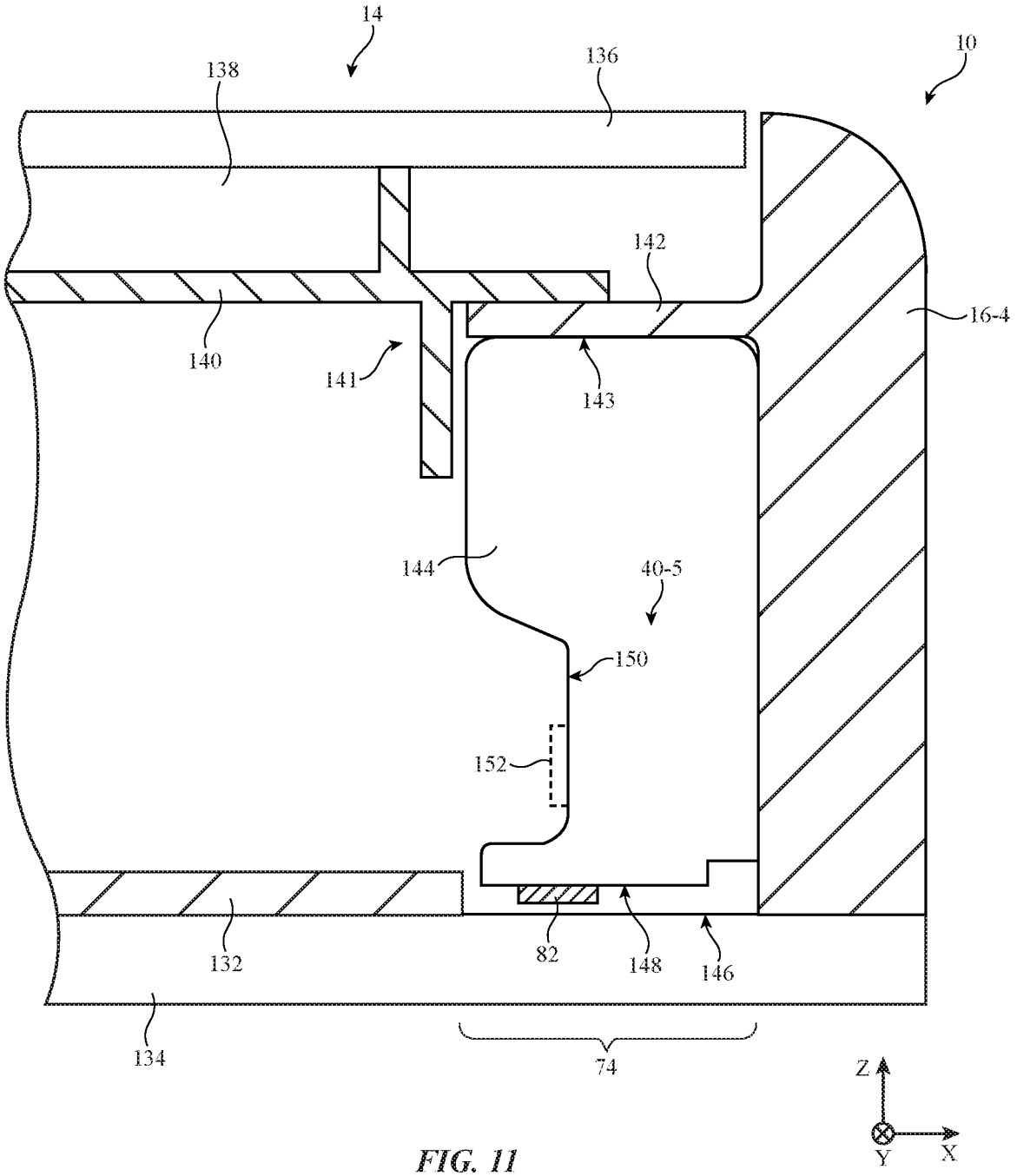
FIG. 11 is a cross-sectional side view showing how an illustrative antenna of the type shown in FIG. 6 may include a conductive trace on a dielectric support structure in accordance with some embodiments.

FIG. 11 is a cross-sectional side view showing how resonating element arm 82 of antenna 40-5 may be formed on a surface of dielectric support structure 144 (e.g., as taken in the direction of line BB' of FIG. 9). As shown in FIG. 11, resonating element arm 82 may be formed from a conductive trace patterned onto lower surface 148 of dielectric support structure 144 facing dielectric cover layer 134. Lower surface 148 of dielectric support structure 144 may be separated from upper surface 146 of dielectric cover layer 134 by a gap (as shown in FIG. 11) or may be pressed against upper surface 146 (e.g., resonating element arm 82 may be pressed against surface 146). In another suitable arrangement, a dielectric spacer (not shown) may fill the space between lower surface 148 of dielectric support structure 144 and upper surface 146 of dielectric cover layer 134. In yet another suitable arrangement, resonating element arm 82 may be formed on other surfaces of dielectric support structure 144. For example, resonating element arm 82 may be formed at location 152 on vertical surface 150 of dielectric support structure 144.

These examples are merely illustrative. In general, dielectric support structure 144 may have any desired shape. Resonating element arm 82 may be formed at any desired location in or on dielectric support structure 144. In another suitable arrangement, resonating element arm 82 may be formed on the flexible printed circuit for antenna 40-5 (e.g., flexible printed circuit 116 of FIGS. 9 and 10).

Figure 12:
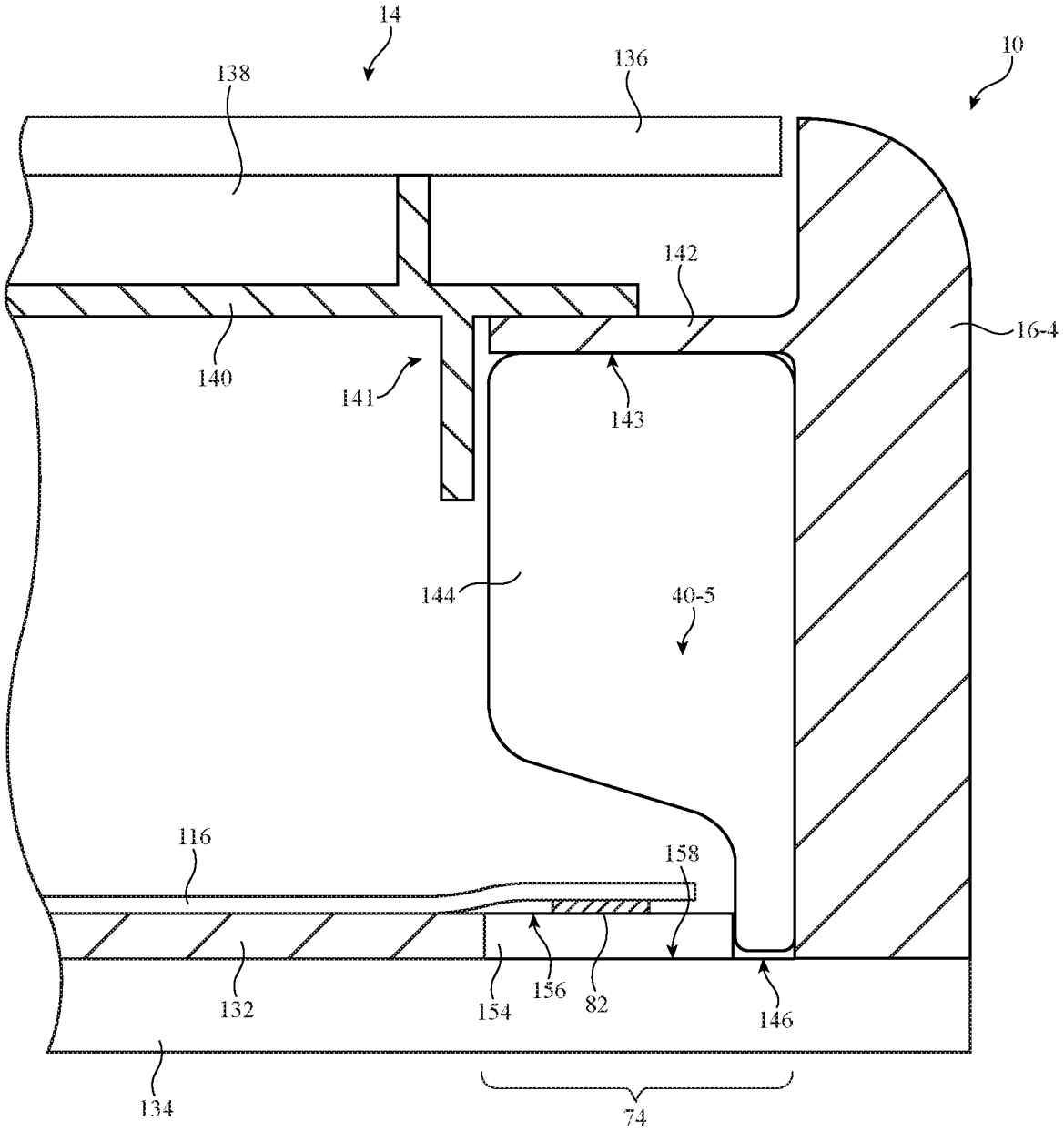
FIG. 12 is a cross-sectional side view showing how an illustrative antenna of the type shown in FIG. 6 may include a conductive trace on a flexible printed circuit that is pressed against a dielectric member in accordance with some embodiments.

FIG. 12 is a cross-sectional side view showing how resonating element arm 82 of antenna 40-5 may be formed on a surface of flexible printed circuit 116 (e.g., as taken in the direction of line BB' of FIG. 9). As shown in FIG. 12, resonating element arm 82 may be formed from a conductive trace patterned onto the bottom surface of flexible printed circuit 116 in a region of flexible printed circuit 116 overlapping slot 74. In the example of FIG. 12, a dielectric member such as dielectric spacer 154 is mounted to upper surface 146 of dielectric cover layer 134 within slot 74 (e.g., lower surface 158 of dielectric spacer 154 may contact upper surface 146 of dielectric cover layer 134). Resonating element arm 82 is pressed against upper surface 156 of dielectric spacer 154 within slot 74. This is merely illustrative and, if desired, dielectric spacer 154 may be omitted and flexible printed circuit 116 may be pressed against upper surface 146 of dielectric cover layer 134 (e.g., resonating element arm 82 may be pressed against upper surface 146 of dielectric cover layer 134). Dielectric support structure 144 may have a cavity that accommodates flexible printed circuit 116 or may be molded over flexible printed circuit 116. In scenarios where dielectric spacer 154 is formed within slot 74, both a portion of dielectric support structure 144 and dielectric spacer 154 may be formed within slot 74. In scenarios where resonating element arm 82 is patterned onto flexible printed circuit 116, conductive screws 128 and 130 of FIG. 9 and screw boss 145 of FIG. 10 may be omitted (e.g., adjustable component 90 and signal conductor 52 of FIG. 9 may be coupled to resonating element arm 82 using conductive traces on flexible printed circuit 116, conductive vias extending through flexible printed circuit 116, etc.). Resonating element arm 82 may be embedded within dielectric spacer 154 if desired.

Figure 13:
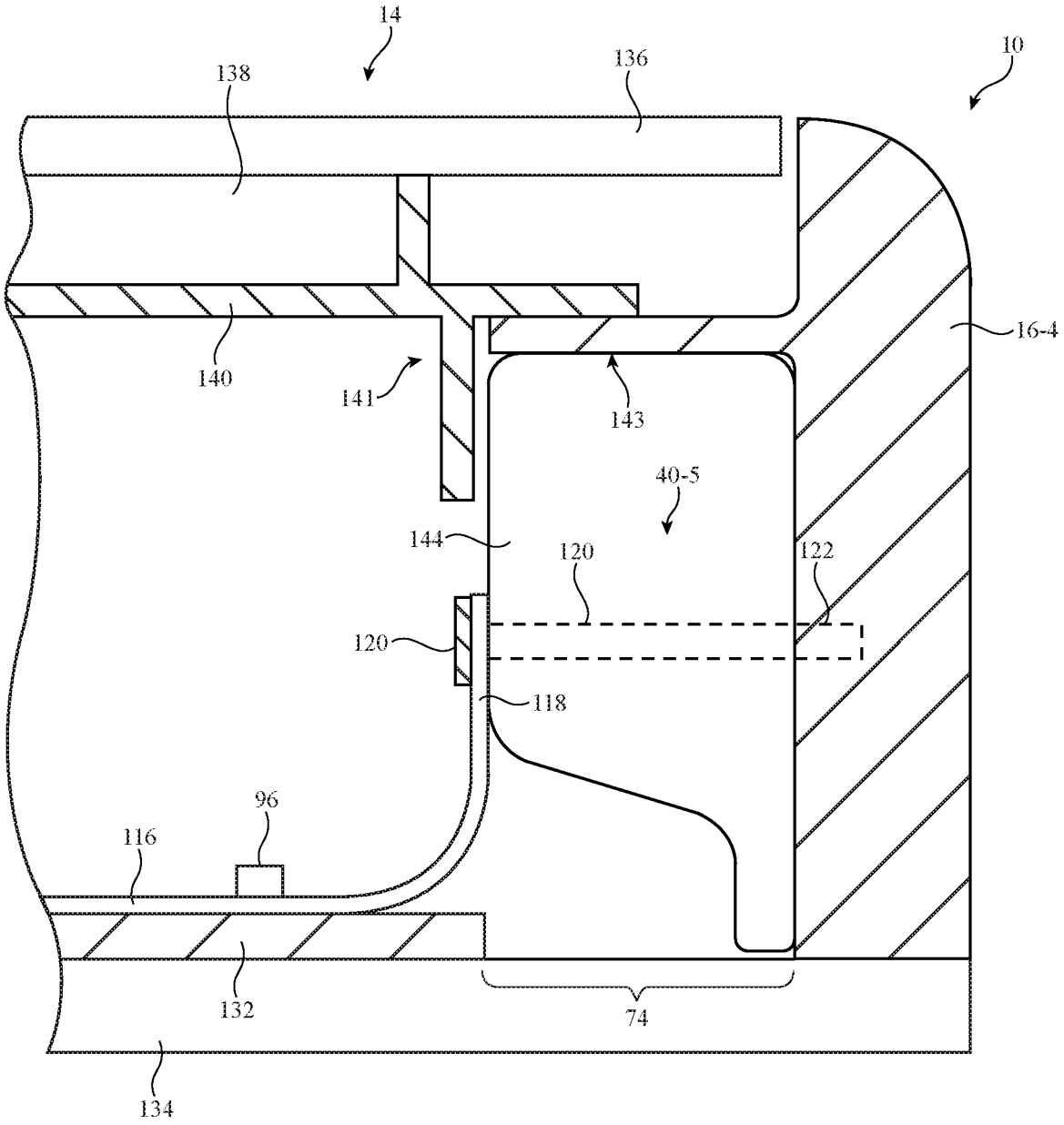
FIG. 13 is a cross-sectional side view showing how an illustrative antenna of the type shown in FIG. 6 may include a conductive path coupled between a flexible printed circuit and a conductive housing wall for tuning the antenna in accordance with some embodiments.

FIG. 13 is a cross-sectional side view showing how adjustable component 96 of FIGS. 6 and 9 may be coupled to segment 16-4 (e.g., as taken in the direction of line CC' of FIG. 9). As shown in FIG. 13, adjustable component 96 may be mounted to flexible printed circuit 116. Adjustable component 96 may include switches, inductors, capacitors, resistors, and/or any other desired tuning circuitry (e.g., tunable components 42 of FIG. 3). Conductive traces for adjustable component 96 may be formed on extension 118. Conductive screw 120 may extend through extension 118 and dielectric support structure 144 to screw hole 122 on segment 16-4. Conductive screw 120 may short the conductive traces for adjustable component 96 on extension 118 to segment 16-4. This may serve to couple adjustable component 96 across slot 74 (e.g., between terminals 100 and 98 of FIG. 6) for tuning the frequency response of slot 74 and thus the frequency response of antenna 40-5. Conductive screw 120 may extend through a vertical (side) surface of dielectric support structure 144 or through any other desired surface of dielectric support structure 144. The example of FIG. 13 is merely illustrative.

The examples of FIGS. 9-13 are merely illustrative. If desired, multiple dielectric support structures may be insert molded around resonating element arm 82. For example, resonating element arm 82 may be embedded (e.g., molded within) an additional dielectric support structure that is formed within slot 74 adjacent to dielectric support structure 144. This may allow conductive screws 130 and 128 of FIG. 9 and screw boss 145 of FIG. 10 to be omitted.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

ground structures;

peripheral conductive housing structures that extend around the ground structures;

conductive interconnect structures that couple the peripheral conductive housing structures to the ground structures;

a slot element having edges defined by the ground structures, the peripheral conductive housing structures, and the conductive interconnect structures;

a resonating element arm overlapping the slot element; and an antenna feed coupled to the resonating element arm and the ground structures, wherein the resonating element arm is configured to radiate in a first frequency band while indirectly feeding the slot element via near-field electromagnetic coupling, the slot element being configured to radiate, in response to being indirectly fed by the resonating element arm, in a second frequency band that is different from the first frequency band.

2. The electronic device defined in claim 1, wherein the second frequency band is lower than the first frequency band.

3. The electronic device defined in claim 2, wherein the first frequency band comprises a first frequency between 3300 MHz and 5000 MHz and the second frequency band comprises a second frequency between 3300 MHz and 5000 MHz.

4. The electronic device defined in claim 3, wherein the electronic device has opposing first and second ends and an edge extending between the first and second ends, the slot element is formed along the edge, and the electronic device further comprises:

a first antenna at the first end that includes a first portion of the ground structures and a first additional resonating element arm formed from the peripheral conductive housing structures; and a second antenna at the second end that includes a second portion of the ground structures and a second additional resonating element arm formed from the peripheral conductive housing structures.

5. The electronic device defined in claim 4, wherein the first and second antennas are configured to radiate in the first frequency band, the second frequency band, a third frequency band comprising a third frequency between 2300 MHz and 2700 MHz, and a fourth frequency band comprising a fourth frequency between 1710 MHz and 2170 MHz.

6. The electronic device defined in claim 5, further comprising:

a third antenna at the first end that includes a third portion of the ground structures and a third additional resonating element arm formed from the peripheral conductive housing structures; and a fourth antenna at the second end that includes a fourth portion of the ground structures and a fourth additional resonating element arm formed from the peripheral conductive housing structures, wherein the third and fourth antennas are configured to radiate in the first, second, third, and fourth frequency bands and in a fifth frequency band comprising a fifth frequency between 600 MHz and 960 MHz.

7. The electronic device defined in claim 1, wherein the conductive interconnect structures comprise a structure selected from the group consisting of: conductive adhesive, sheet metal, an integral portion of the peripheral conductive housing structures, a conductive clip, conductive foam, metal foil, a conductive trace on an underlying substrate, and a conductive spring.

8. The electronic device defined in claim 1, wherein the slot element has a length and a width that is less than the length, the resonating element arm having a first end coupled to the antenna feed and an opposing second end that extends parallel to the length of the slot element.

9. The electronic device defined in claim 8, wherein the second end of the resonating element arm is located within 20% of the length from the center of the slot element.

10. The electronic device defined in claim 1, further comprising:

an adjustable component coupled between the resonating element arm and the ground structures, the adjustable component being configured to tune the first frequency band.

11. The electronic device defined in claim 10, further comprising:

an additional adjustable component coupled between the peripheral conductive housing structures and the ground structures across the slot element, the additional adjustable component being configured to tune the second frequency band.

12. The electronic device defined in claim 11, further comprising:

a flexible printed circuit, wherein the adjustable component and the additional adjustable component are mounted to the flexible printed circuit; and a signal conductor on the flexible printed circuit, wherein the signal conductor is coupled to the resonating element arm.

13. The electronic device defined in claim 12, further comprising:

a conductive support plate that forms a part of the ground structures, wherein the conductive support plate defines an edge of the slot element;

a dielectric cover layer for the electronic device layered under the conductive support plate; and a display mounted to the peripheral conductive housing structures.

14. The electronic device defined in claim 13, wherein the resonating element arm comprises a conductive trace on the flexible printed circuit and overlapping the slot element, the electronic device further comprising a dielectric spacer interposed between the dielectric cover layer and the conductive trace.

15. The electronic device defined in claim 13, further comprising:

a dielectric support structure overlapping the slot element, wherein the dielectric support structure is configured to mechanically support the display and the resonating element arm is formed on the dielectric support structure.

16. The electronic device defined in claim 15, further comprising:

a first conductive screw that extends through the flexible printed circuit and at least some of the dielectric support structure to electrically couple the signal conductor to the resonating element arm; and a second conductive screw that extends through the flexible printed circuit and at least some of the dielectric support structure to electrically couple the additional adjustable component to the peripheral conductive housing structures.

17. An antenna comprising:

conductive structures that define a closed slot;

a monopole element overlapping the closed slot; and an antenna feed having a positive antenna feed terminal coupled to the monopole element, wherein the antenna feed is configured to convey radio-frequency signals to the monopole element, the monopole element is configured to radiate the radio-frequency signals in a first frequency band, the monopole element is configured to indirectly feed the radio-frequency signals to the closed slot via near-field electromagnetic coupling, and the closed slot is configured to radiate the radio-frequency signals in a second frequency band that is lower than the first frequency band.

18. The antenna defined in claim 17, wherein the closed slot has a length and a width that is less than the length, the monopole element has an end coupled to the positive antenna feed terminal and a tip that opposes the end, the tip extends parallel to the length of the closed slot, and the first and second frequency bands each comprise a respective frequency between 3300 MHz and 5000 MHz.

19. An electronic device having opposing front and rear faces, the electronic device comprising:

a dielectric cover layer at the rear face;

a conductive support plate on the dielectric cover layer;

a display having a display cover layer at the front face;

peripheral conductive housing structures that extend from the dielectric cover layer to the display cover layer;

a slot antenna radiating element having opposing edges defined by the conductive support plate and the peripheral conductive housing structures, the slot antenna radiating element being configured to radiate in a first frequency band;

a monopole antenna radiating element overlapping the slot antenna radiating element, the monopole antenna radiating element being configured to radiate in a second frequency band that is higher than the first frequency band; and an antenna feed configured to directly feed radio-frequency signals to the monopole antenna radiating element, the monopole antenna radiating element being configured to indirectly feed the radio-frequency signals to the slot antenna radiating element via near-field electromagnetic coupling.

20. The electronic device defined in claim 19, further comprising:

a dielectric support structure overlapping the slot antenna radiating element, wherein the monopole antenna radiating element is formed on the dielectric support structure;

a flexible printed circuit having a signal conductor for a radio-frequency transmission line; and a conductive screw that electrically couples the signal conductor to the monopole antenna radiating element.

* * * * *